US008279030B2

(12) United States Patent
Baker et al.

(10) Patent No.: US 8,279,030 B2
(45) Date of Patent: Oct. 2, 2012

(54) METHOD AND APPARATUS FOR ELECTRICAL, MECHANICAL AND THERMAL ISOLATION OF SUPERCONDUCTIVE MAGNETS

(75) Inventors: Devlin Baker, Bellingham, WA (US); Daniel Bateman, San Francisco, CA (US)

(73) Assignee: Magnetic-Electrostatic Confinement (MEC) Corporation, Glenbrook, NV (US)

( * ) Notice: Subject to any disclaimer, the term of this patent is extended or adjusted under 35 U.S.C. 154(b) by 187 days.

(21) Appl. No.: 12/567,765

(22) Filed: Sep. 26, 2009

(65) Prior Publication Data

US 2010/0085137 A1 Apr. 8, 2010

Related U.S. Application Data

(60) Provisional application No. 61/100,717, filed on Sep. 27, 2008.

(51) Int. Cl.
*H01F 6/00* (2006.01)

(52) U.S. Cl. ..... 335/216; 335/296; 324/319

(58) Field of Classification Search ..... 335/216, 335/296–299; 324/319–321
See application file for complete search history.

(56) References Cited

U.S. PATENT DOCUMENTS

| | | | | |
|---|---|---|---|---|
| 3,480,895 | A * | 11/1969 | Albrecht et al. | 336/60 |
| 4,826,646 | A | 5/1989 | Bussard | |
| 5,016,638 | A * | 5/1991 | Hsieh | 600/410 |
| 5,160,695 | A | 11/1992 | Bussard | |
| 5,448,214 | A * | 9/1995 | Laskaris | 335/301 |
| 5,651,256 | A * | 7/1997 | Herd et al. | 62/51.1 |
| 6,043,653 | A * | 3/2000 | Takamori et al. | 324/309 |
| 6,078,234 | A * | 6/2000 | Huang et al. | 335/216 |
| 7,633,014 | B2 | 12/2009 | Allais et al. | |
| 2007/0173157 | A1 | 7/2007 | Trifu et al. | |
| 2008/0164048 | A1 | 7/2008 | Hirose | |
| 2008/0187086 | A1 | 8/2008 | Bussard et al. | |

FOREIGN PATENT DOCUMENTS

| | | | |
|---|---|---|---|
| EP | 1887584 | A1 | 2/2008 |
| JP | 2002-140943 | A | 5/2002 |

OTHER PUBLICATIONS

Bussard, Robert W. "The Advent of Clean Nuclear Fusion: Superperformance Space Power and Propulsion." *57th International Astronautical Congress*, Valencia, Spain. Oct. 2-6, 2006. Engergy/Matter Conversion Corporation (EMC2), Santa Fe, New Mexico. IAC Paper, Sep. 2006. 30 pages.

International Search Report for International Application No. PCT/IB2009/054429 mailed May 31, 2010. 2 pages.

Krall et al. "The Polywell: A Spherically Convergent Ion Focus Concept." *Fusion Technology*. vol. 22, Aug. 1992. 9 pages.

* cited by examiner

*Primary Examiner* — Bernard Rojas
(74) *Attorney, Agent, or Firm* — Eric Prahl

(57) ABSTRACT

A method and apparatus of electrical, mechanical and thermal isolation of superconductive magnet coils includes a superconductive magnet for environments wherein large differences of electrical potential between the interior superconductive winding and the exterior of the device, on the order of $10^3$to $10^6$ Volts may exist. The methods and apparatus also includes insulation, cooling, and structural elements such that the interior of the device is capable of maintaining cryogenic temperatures needed for superconductivity, even in the presence of high heat flux incident on the overall winding housing. Finally, a device includes structural elements for support against gravity and other forces exerted on the assembly that include expansion jointing and stabilization to minimize warping or bending of the assembly due to temperature gradients. These supports include accoutrements for supplying electrical power, cryogenic coolant, and other supply leads to the magnet head, while also being isolated from thermal and electrical effects.

34 Claims, 29 Drawing Sheets

METHOD AND APPARATUS FOR ELECTRICAL, MECHANICAL AND THERMAL ISOLATION OF SUPERCONDUCTIVE MAGNETS

CROSS-REFERENCES TO RELATED APPLICATIONS

This application claims priority to and the benefit of U.S. Provisional Application Ser. No. 61/100,717, filed Sep. 27, 2008, the disclosure of which is incorporated herein by reference in its entirety.

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

Embodiments in accordance with the present invention relate generally to superconductive magnets, and more particularly relates to methods for housing the magnets in environments of extreme electrical and thermal gradients. Embodiments of the invention may also be built as to be highly resistant to ionizing radiation and its deleterious effects on superconductive materials.

The electrical and thermal isolation abilities of the present invention are applicable to the field of Magnetohydrodynamic (hereinafter "MHD") devices such as direct kinetic-to-electrical energy converters. Compact and rugged MHD converter devices could be used to convert the kinetic energy of a jet or rocket exhaust stream into electrical power at high efficiency. Housing sensitive superconductive materials at the periphery of super-heated exhaust stream is only practical with thermal and mechanical isolation of the superconductive magnet (i.e. the magnet coil, coil support structure, cooling system and thermal insulation) in accordance with the present invention.

The methods and apparatus of electrical, mechanical and thermal isolation of superconductive magnets relates to the field of superconductive magnet design, fabrication, and operation. More specifically, the methods and apparatus of electrical, mechanical and thermal isolation of superconductive magnets relates to methods for housing superconductive magnets in environments of extreme electrical and thermal gradients. Various embodiments may also be built as to be highly resistant to various forms of radiation (including ionizing radiation) and its deleterious effects on superconductive materials.

The disclosure herein applies additionally to other processes and devices requiring a high magnetic field wherein high heat or high thermal gradient(s), a high electric field or high electric field gradient(s), or various forms of radiation are present.

This invention also applies to the field of Nuclear Magnetic Resonance (hereinafter "NMR") and Magnetic Resonance Imaging (hereinafter "MRI"), wherein superconductive magnets constructed in accordance with the present invention will allow for material analysis and imaging devices to be able to withstand more extreme electrical, thermal, and radiative environments. The invention is also applicable to the field of Mass Spectrometry. Mass spectrometers built using superconductive magnets per the current invention will have a much greater operational range of temperature, vibration, and radiation exposure. The present invention also applies to the field of advanced space propulsion.

Finally, the current invention relates to the field of magnetic materials separation, where the invention will be used to provide intense magnetic fields to remove magnetic elements from the substance being processed. Magnets built in accordance with one or more of the current embodiments herein disclosed would allow a greater operational temperature range for such devices.

SUMMARY OF THE INVENTION

Methods and apparatus in accordance with various embodiments of the present invention are designs for a superconductive magnet housed within an assembly that provides cooling, thermal insulation, structural support, and may also provide high potential difference electric insulation. In certain aspects, various methods of cooling may include cryogenic cooling. Those skilled in the art may readily recognize additional cooling methods, which are contemplated to be implemented with the disclosed technology herein.

In one embodiment, the electric insulation includes one or more layers of dielectric material. In some embodiments, one or more of the dielectric layers may be ceramic, glass, polymer or other applicable dielectric materials depending on the particular application. The one or more dielectric layers insulating the superconductive magnet allow an electrically conductive layer exterior to the dielectric layers to be held at high electric potential difference relative to the superconductive coil winding, cooling system and winding housing.

The innermost layers surrounding the superconductive coil winding consist of structural support for the coil winding itself, which may double as flow channels for actively pumped coolant. In certain aspects, a layer of metalized woven polymeric fabric wrap (in various aspects, a reflective "superinsulation") in conjunction with a flexible low density silica-based layer of thermal insulation with extremely low thermal conductivity is provided between the dielectric layer and the structural support/cooling system layer.

Three or more struts may support the superconductive magnet assembly, which may provide support against the force of gravity or other forces incident on the magnet assembly during operation. One or more of these support struts may be hollow, providing a cavity through which coolant supply, electrical supply, or other supply conduits may be run. In various aspects, the superconductive magnet assembly may optionally be toroidal or other applicable geometric configurations. In one embodiment, the outer one or more layers of the support struts may be one or more layers of dielectric material.

When the outermost layer of the magnet assembly to be subjected to high heat flux or radiation of various forms, an additional near ambient temperature cooling system may be incorporated into the superconductive magnet assembly and associated systems. In one embodiment, the additional near ambient temperature cooling system has dielectric coolant and dielectric coolant supply lines such that an outermost electrically conductive layer, in contact with one or more of the dielectric coolant materials or dielectric coolant supply lines, may still be held at high electric potential.

In another embodiment, a method of providing electrical insulation and mechanical support of one or more superconductive electromagnets, comprising the steps of encasing the one or more superconductive magnets with one or more layers of dielectric material and encasing the one or more layers of dielectric material with one or more layers of electrically conductive material, said one or more layers of dielectric material collectively having a dielectric strength greater than the quotient of (1) and (2) wherein (1) is a maximum electric potential difference (voltage) between (i) and (ii) wherein (i) is the one or more superconductive magnets; and (ii) is the one or more layers of electrically conductive material that encase the one or more layers of dielectric material that encase the one or more superconductive magnets; and (2) is a collective thickness of the one or more layers of dielectric material; and providing mechanical support for the one or more superconductive magnets wherein each magnet is held at a distance from a surface of a structure that supports the one or more superconductive magnets, such that the shortest distance between (3) and (4) is greater than the quotient of (5) and (6) wherein (3) is an outermost surface of the one or more layers of electrically conductive material; (4) is the surface of the structure that supports the one or more superconductive magnets; (5) is the maximum electric potential difference (voltage) between (i) and (ii) wherein (i) is the one or more superconductive magnets; and (ii) is the one or more layers of electrically conductive material that encase the one or more layers of dielectric material that encase the one or more superconductive magnets; and (6) is an effective dielectric strength of a medium (intervening substance) between (3) and (4).

In another embodiment, the method may also include steps for providing one or more innermost layers of high-K dielectric material comprising a structural support structure for the coil, which also functions as one or more flow channels for actively pumped cryogenic coolant.

In yet another embodiment, a method for mechanical support, electrical isolation, and thermal insulation of one or more superconductive electric magnets, comprises the steps of supporting the superconductive electric magnet winding, winding housing, and cryogenic coolant; isolating one or more layer elements including a toroidal section of dielectric composed of an upper and lower half; and thermally insulating one or more superconductive magnetic coils.

In other various aspects of the embodiment, the method may include steps for isolating one or more layer elements including a toroidial section of dielectric composed of an upper and lower half and further including dissolving silicates in a hydroxide solution. In other various aspects, the method may also include steps for isolating one or more layer elements comprising a toroidial section of dielectric composed of an upper and lower half and further comprising the step of wrapping flexible glass fibers around a toroidial section; and treating said fibers with an epoxy solution. In certain aspects, the method may include steps wherein thermally insulating one or more superconductive magnetic coils further comprises the step of incorporating a layer of radiation shielding between an outer layer and said dielectric layer.

In another embodiment, a method of providing electrical insulation and mechanical support of one or more superconductive electromagnets may further comprise steps for providing one or more layers of vacuum impinged metalized woven polymeric fabric wrapping coupled with a flexible low density silica-based layer of thermal insulation containing high reflectivity, low thermal conductivity material.

In another embodiment, a superconductive magnetic coil, comprises a layer of a high-K dielectric material; a layer of vacuum impinged fabric wrapping providing one or more layers of vacuum impinged metalized woven polymeric fabric wrapping coupled with a flexible low density silica-based layer of thermal insulation containing high reflectivity, low thermal conductivity material; and a layer of thermal insulation. In certain aspects, the embodiment may also include a layer of high-K dielectric material includes individual filaments contained in a copper matrix or larger cable comprised of multiple braided filaments and additional binding material; a winding of cable-in-conduit Rutherford cables, wherein superconductive filaments in a copper matrix are braided around a central copper channel wherein the exterior cables are covered with an insulating material; a layer of vacuum impinged metalized woven polymeric fabric wrapping; and a layer of thermal insulation.

In another embodiment, a winding support structure, comprises a stainless steel toroidal container consisting of an upper and lower half affixed to a coil winding; one or more orifices coupled to a plurality of supply leads on said lower half wherein one or more cables are separated by an offset; mounting plates coaxial to said cable orifices; and one or more additional struts offset from a first pair of struts wherein said struts extend downward along one or more coil radii. In certain aspects, the embodiment may also include a one or more surrounding layers of metalized nylon held under high vacuum; one or more layers surrounded by an airtight metal cavity; an additional layer of thermal insulation; and one or more flexible sheets of nanoporous gels wrapped in sheets and affixed together by a high strength fiber. In other various aspects, the embodiment may also include a housing that contains the winding support structure within a vacuum chamber and provides an internal vacuum such that an inner structural element surrounding the winding is sealed. In other various aspects, the embodiment may include a cooling system, a cooling system with high dielectric properties, channels wherein dielectric coolant may be pumped, channels etched into the exterior of the solid dielectric layer, tubing composed of dielectric material wherein said tubing provides dielectric coolant to the coil head and through the hollowed portions of interior support struts, a minor radius cross section following the contour of a magnetic field line surrounding an outer metallic layer, and a coil with a minor radius cross section that is slightly elliptical.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

DETAILED DESCRIPTION

Figure 1:
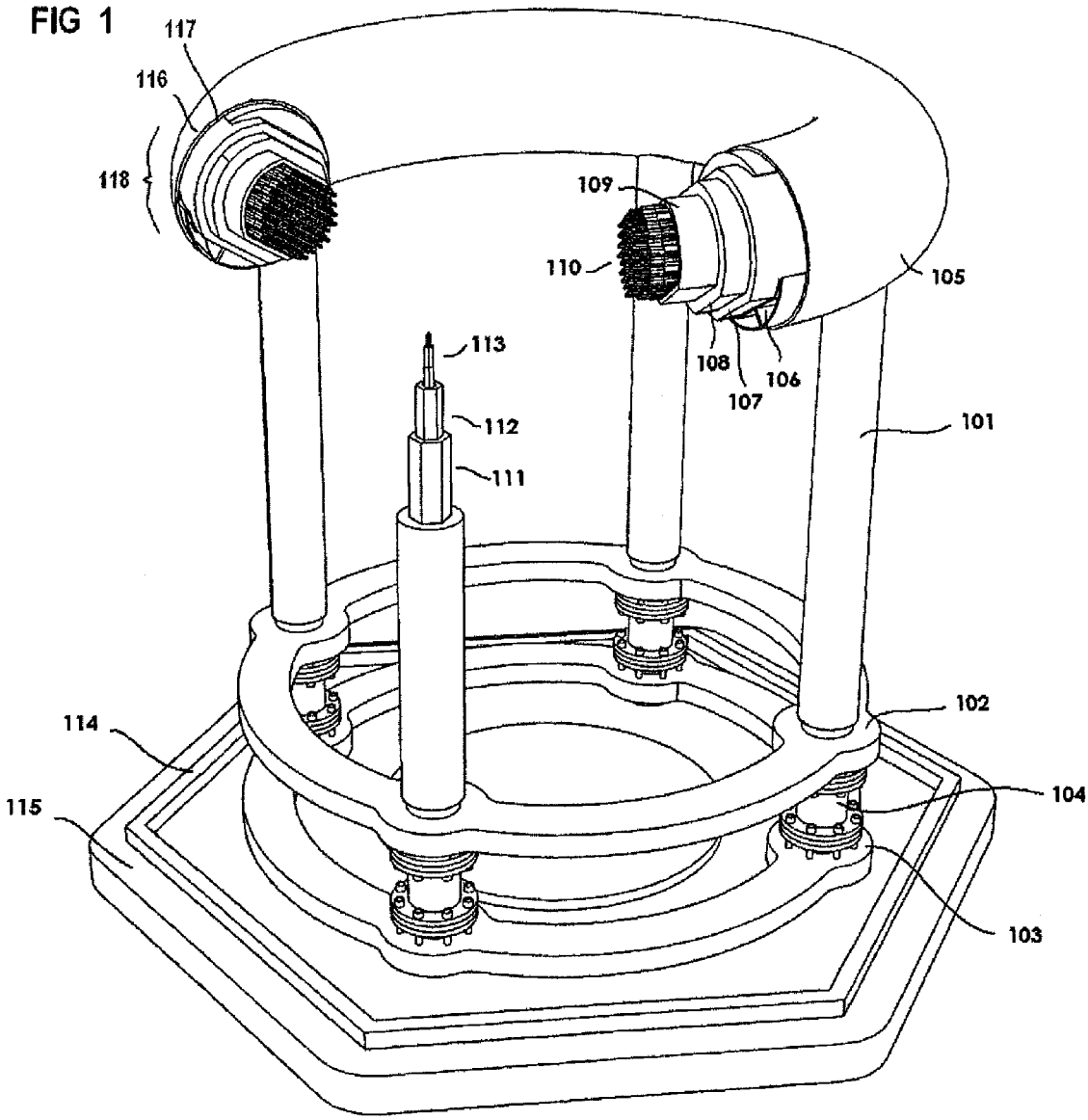
FIG. 1 is a 3-dimensional cutaway representation of the exterior and interior of one embodiment of the invention, designed for installation in a chamber.

Methods and apparatus in accordance with various embodiments of the present invention overcome the aforementioned and other deficiencies in existing mechanical, electrical, and thermal isolation of one or more superconductive magnets.

In one embodiment of the invention, the superconductive winding is wound radially with a circular cross section, giving a dipole magnetic field. The winding itself may be of individual superconductive filaments in a copper matrix, or of larger cable composed of multiple braided filaments and additional copper binders. The superconductive filaments may be of the high-temperature (HTSC) or low-temperature (LTSC) type. HTSC superconductors may be preferable in embodiments subject to greater heat flux, as the critical temperature for HTSC windings is higher, and subsequently the input power required to cool them is reduced. However, LTSC windings present advantages of durability under the effects of radiation, at the cost of higher cooling power requirements. In certain aspects, all embodiments may variously include a superconductive magnet that comprises a superconductive winding, winding housing, cryogenic coolant, and coolant housing. All embodiments may also include an outer metallic layer comprising an electrically conductive material that surrounds the dielectric material that surrounds the superconductive magnet. In other certain aspects, a first voltage comprises the electric potential difference between the superconductive magnet and the outer metallic layer. In other various aspects, embodiments variously Include a surrounding medium wherein the medium which surrounds the outer metallic layer and surrounds the dielectric layer that also surrounds the support rods.

In the case of both LTSC and HTSC filaments, the preferred embodiment of the invention utilizes a winding of cable-in-conduit Rutherford type cables, where superconductive filaments in a copper matrix are braided around a central copper channel. This channel is filled with the desired cryogenic coolant, and pumped actively as to provide forced convection cooling. Possible coolants include various fluids including liquid helium, liquid nitrogen, liquid hydrogen and supercritical gases, as well as many others. A fluid herein shall be considered as a continuous, amorphous substance whose molecules move freely past one another and that has the tendency to assume the shape of its container. The exterior of these cables are covered by a durable electrical insulator such as polyamide.

Other embodiments include a solid winding, which is cooled by externally pumped cryogenic coolant, and windings cooled directly by conduction via closed-cycle cryocoolers.

The complete magnet winding may then be bound together with an epoxy under vacuum impregnation, or wrapped again with polyamide, as required for the specific application. In the embodiment mentioned earlier, this element is toroidal (donut shaped), with positive and negative leads of the internally cooled Rutherford type cable extending a few coil radii such that electrical power as well as coolant flow may be provided to the winding.

On the exterior of the winding, the next layer is composed of winding support structure(s). In one embodiment, this consists of a stainless steel toroidal container composed of an upper and lower half, which is bolted or welded together around the coil winding. Two small orifices on the bottom half allow for the supply leads (coolant and power) to be passed through.

In the preferred embodiment, these two cables are separated by 180 degrees. Coaxial to these cable orifices are mounting plates for the support struts, and a pair of additional struts are offset by 90 degrees from the first pair. The internal structural elements of the support struts are attached here, and extend downward along some number of coil radii. In various aspects, another embodiment may variously include welding the support struts to the toroidal container which container which houses the superconductive magnet.

Surrounding the steel support structure there may be multiple layers of metalized nylon, metalized woven polymeric fabric wrapping. These are to be housed in a container, the interior of the container to be held under high vacuum thereby providing thermal insulation properties. In one embodiment, this layer is surrounded by an air-tight metal cavity such that the area can be evacuated to high vacuum. In another embodiment, the assembly is designed to be housed within a vacuum chamber, and designed to create provisions for providing an internal vacuum. Note that in this embodiment, the inner structural element surrounding the winding is sealed, so that small coolant leaks do not ruin the vacuum.

The metalized woven or polymeric fabric wrapping layer is surrounded by an additional layer of thermal insulation, such as an extremely high R-value foam or silica-based blanket. One embodiment utilizes flexible sheets of extremely low density nanoporous gels. These may be wrapped in sheets, and held in place by a high strength fiber thread material.

Surrounding the thermal insulation layers elements designed for electrical isolation are present. These consist of a toroidal section of dielectric composed of an upper and lower half, or multilayer wrapping of a flexible dielectric. For maximum electrical isolation, one embodiment consists of fused-silica (low metal content glass) halves. These may be joined together by a number of methods, including melting and pressure welding of the two halves together. If this method is employed, great care must be taken as to not damage the internal coil windings, as superconductive materials are very sensitive to high temperatures. Filling the coolant chambers with a cryogenic coolant during this process is one method for minimizing the chance of thermal degradation of the windings.

A further method for joining the dielectric sections involves dissolution of silicates in a hydroxide solution. This solution may be applied to the interface, and upon evaporation of the solution solid a solid silicate bond will remain. Another embodiment may use a wrap of flexible glass fibers around the toroidal section to the desired thickness, which are then treated with an epoxy or silicate-hydroxide solution to seal any small orifices or pores. Additional embodiments may use an epoxy-based dielectric, ceramics, or polymers. Silica and ceramics are preferred for high-temperature and vacuum applications, as polymers and epoxies tend to out-gas and degrade when heated.

According to one aspect of the present invention, the exterior layer of the coil head is a rigid metallic element, designed to resist the effect of electromagnetic radiation of various wavelengths. Radio, infrared, and soft x-ray radiation as well as intermediate wavelengths will be largely absorbed by this layer. Polishing the exterior surface will act to increase the amount of electromagnetic radiation reflected, and increase its blackbody emissivity, speeding cooling.

Another embodiment is required when the electromagnetic or convective heat load on the outer layer is high, an additional cooling system would need to be included. In order to retain electrical isolation between the outer skin of the coil head and ground, this coolant must itself have strong dielectric properties. These requirements are meet by but not limited to: highly refined mineral oil, fluorinated hydrocarbons, and silicone based commercial transformer fluids. The best mode material for retaining electrical isolation is silicone based fluids, as they do not have the same risk of combustion as do mineral oils.

In yet another embodiment, the outer metallic element may include small channels within which the dielectric coolant may be pumped, or channel may be etched into the exterior of the solid dielectric layer, providing cooling along the metal-dielectric interface. With this embodiment, care must be taken that the solid dielectric material does not interact deleteriously with the dielectric fluid, as would be the case with a fluorinated hydrocarbon and some polymers. The tubing providing dielectric coolant to the coil head is run down the interior hollow section of the support struts, specifically those than do not house a superconductive cable lead. This tube must be also composed of dielectric material, as to avoid conducting electricity to the pumping systems, which are at ground potential.

In one embodiment, when high flux of neutral particle radiation such as neutrons or gamma rays is expected, the design should incorporate a layer of radiation shielding between the outer container and the dielectric layer. This is only practical on large devices, where the minor radius of the coil exceeds 10 cm. This radiation shielding may be in the form of dense metals like lead, or borated carbon-composite sheeting.

In one embodiment, the high flux of charged particles requires that, the shape of the outer metallic layer conforms to the magnetic field lines. This not only reduces mechanical stresses on the device, but more importantly it reduces charged particle impacts by limiting the degree to which field lines, which are the guiding centers of charged particle gyromotion, terminate on a metal surface.

According to another embodiment, a single isolated coil, the preferable minor radius cross section is slightly elliptical, with the flattened side facing inward toward the axis of the coil. For arrays of coils or in the presence of external magnetic fields, the geometry of the cross section will vary accordingly such that a minor radius cross section follows the contour of a magnetic field line surrounding an outer metallic layer.

In another embodiment, the coil head is supported by a number of support struts, the inner structural element of which is hollow to provide a channel for support cables and conduits to be run. This element is covered with layers of thermal insulation and dielectric of similar thickness to that found on the coil head. However, there is not an outer metal layer on the struts, allowing the outermost metal container on the coil head to be completely electrically isolated from the rest of the assembly. The struts are attached to a pair of support rings, which incorporate thermally insulated bushings and expansion joints. This prevents excessive degrees of heat from being conducted to the interior coil windings. The lower ring is attached to a mounting plate, which serves as a structural base, as well as a means to attaching the assembly to the desired location.

In one embodiment of the invention, the electrical insulation comprises a layer of high-K dielectric ceramic, glass or polymer, such that the outermost metallic layer of the assembly may be held at high electric potential difference from the coil winding. In certain aspects, a layer of vacuum-impinged metalized woven polymeric fabric wrapping, in conjunction with a flexible low density silica-based layer of thermal insulation with extremely low thermal conductivity is provided. The innermost layers provide structural support for the coil winding and cooling system, which may double as flow channels for actively pumped cryogenic coolant. The toroidal coil head assembly is then supported by three or more struts, providing gravity support. These struts are hollow, providing a cavity through which cryogenic and electrical supply conduits may be run. The outermost layer of the struts, in contrast to the toroidal coil head, is a thick dielectric rather than metal. If the exterior of the coil head is to be subjected to high heat flux, an additional near room temperature cooling system may be incorporated. This system has coolant and supply lines of dielectric materials such that the exterior of the coil head may still be held at high electric potential despite contact with the coolant without the risk of internal arcing.

FIG. 1 further illustrates a 3-dimensional cutaway of one embodiment of the invention, designed for installation in a vacuum chamber. This embodiment is intended for generating a dipole magnetic field. The superconductive winding 110 is supplied with current and coolant by an input conduit 113 is surrounded by a structural element 109 that also serves as a container, which contains the liquid or gaseous coolant. In certain aspects, the coolant may be cryogenic coolant in a cryocontainer. Because the structural element must be maintained at extremely low temperature, austenitic steel alloys are preferred. The coolant may be one of a number of different types, including liquid gases such as liquid nitrogen or liquid helium, or supercritical gases at pressures sufficient to prevent phase-change at low temperature. If the transition temperature of the material used in the winding is below 10K, supercritical helium is the preferred option.

To isolate the super-cooled coil winding from conductive heating, a plurality of systems are employed. An insulating blanket layer composed of multiple vacuum-impinged mylar sheets (commonly known as "superinsulation") or an extremely low-density solid such as aerogel may be used for this purpose. A layer of insulation 108 is present on the coil head itself, covering the structural element. In certain aspects, the structural element 109 may variously be a winding housing or coil head cryocontainer 109. In other various aspects, the cryocontainer 109 may be a cryostat 109. A thermal insulation material 111 also covers the structural support rods 112. The support rods 112 are thus also super-cooled by conductive contact with the cryostat. The support rods must then be isolated from ambient temperature components by thermal standoffs 104. To provide structural integrity, two support rings 102 and 103 provide transverse rigidity of the assembly. The upper ring 102 is referred to as the "cold ring", as it is in partial contact with the cooling components. In certain aspects, the cooling components may include super-cooled cryogenic components. The lower ring 103 is referred to as the "warm ring", being at near-ambient temperature. The warm ring is attached to the base plate 115, which in this embodiment has a flange seal 114 for mounting the assembly in the port of a vacuum chamber. A secondary coolant system consists of a chilled dielectric coolant channel 106 that is near the surface of the assembly. In order to retain electrical isolation between the metallic outer skin (steel, tungsten, or titanium) of the coil head 105 and ground, this coolant must itself have strong dielectric properties. Highly refined mineral oil, fluorinated hydrocarbons, and silicone based commercial transformer fluids meet these requirements. Silicone based fluids are preferable, as they do not have the same risk of combustion as do mineral oils. This coolant is pumped through a system of chillers and heat sinks sufficient to maintain a near room-temperature (less than 70 C) temperature of the outer container, limiting the cooling power load on the primary cooling system. In certain aspects, the primary cooling system may be cryogenic. To isolate the coil head container 105 electrically from ground and from the coil winding, one or more layers of dielectric material 107 and 101 surround the thermal insulation layer 108 on the coil head and supports, respectively. The dielectric strength of this material must be relatively high. In some embodiments, the dielectric material may be fused-silica (quartz-glass) for this layer. The thickness is dictated by the voltages that must be maintained. In some embodiments, the dielectric material may be in a thickness ranging from about 0.1 cm to about 50 cm. The potential difference (v, voltage) between the coil head container 105 and the electrical ground varies as a function of the product of the dielectric strength (Dk) and the thickness (L) of the dielectric material. In some embodiments using fused-silica, approximately 1 cm is required for every 50 kV of potential difference between the coil head container and ground. The coil head container 105 further comprises an outer diameter 116 and an inner diameter 117. The coil head assembly 118 comprises the superconductive winding 110, the cryostat/structural element 109, thermal insulation layer 108, dielectric material 107, the chilled dielectric coolant channel 106, and the coil head container 105.

Figure 2A:
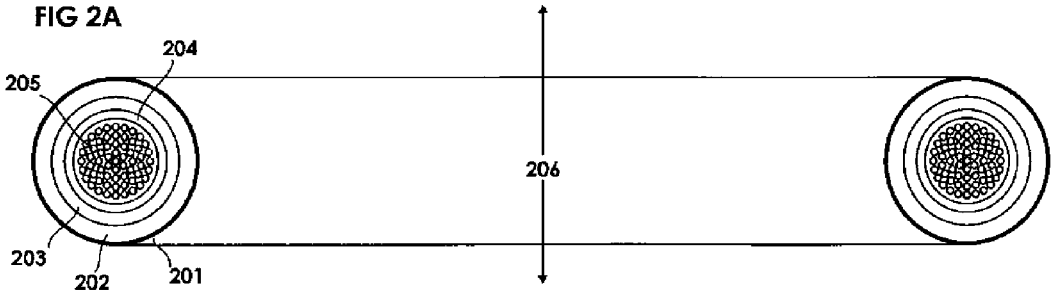
FIG. 2A is a cross-section of a toroidal magnetic coil head, with a large ratio of major radius to minor radius, having a coil container geometry that is conformal to the generated magnetic fields.

Referring now to FIG. 2A, a cross section of a coil head of similar form to that shown in FIG. 1 is pictured. This is a toroidal winding of superconductor 205 around axis of symmetry 206 having a circular cross section. A cryostat/structural element 204, thermal blanket 203, one or more dielectric layers 202 and coil head container 201 surround the superconductive winding and share similar circular cross sections. This is necessary to provide maximum conformality between the material surface of the assembly and the generated magnetic field lines. This reduces mechanical stresses on the device and reduces charged particle impacts by limiting the degree to which field lines (which are the guiding centers of charged particle gyromotion) terminate on a metal surface. For systems to be used in contact or in close proximity to plasmas or charged particle sources this is very important, as it reduces heating of the exterior of the coil head which might otherwise overwhelm the cooling system. For a skinny coil with a large major radius, a circular cross section fulfills these requirements.

Figure 2B:
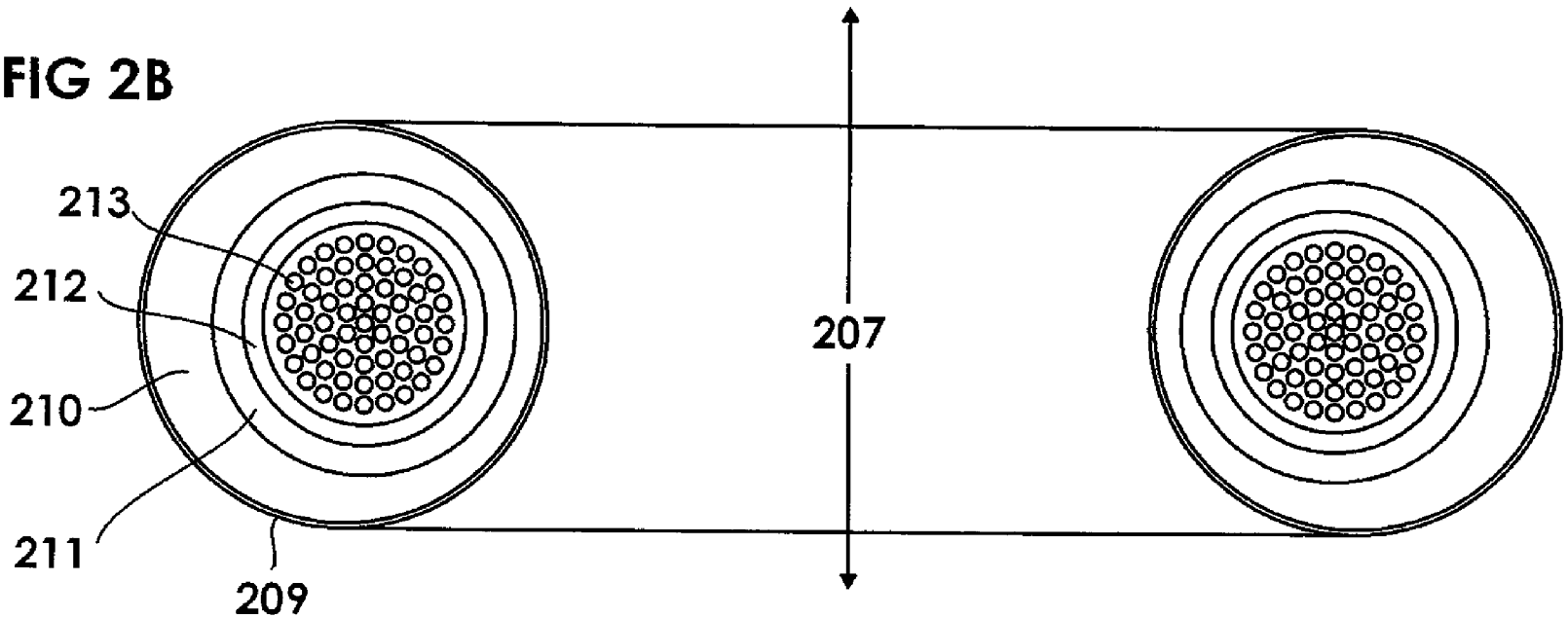
FIG. 2B is a cross-section of a toroidal magnetic coil head, with a small ratio of major radius to minor radius, having a coil geometry that is conformal to the generated magnetic fields, the coil geometry characterized by an offset or elongation of the outer coil container.

In another embodiment, a fatter coil with a comparatively smaller major radius is shown such as that pictured in FIG. 2B, field lines in the bore of the coil, near axis of symmetry 207, are compressed by the proximity of the opposite side of the coil, and circular cross sections are no longer ideal. In this case, the circular cross section coil winding 213 is surrounded by circular cross section cryostat/structural element 212 and thermal insulation 211, but one or more dielectric layers 210 is offset outward and slightly elliptical to accommodate a field-conformal coil head container 209, which is similarly offset outward.

Figure 2C:
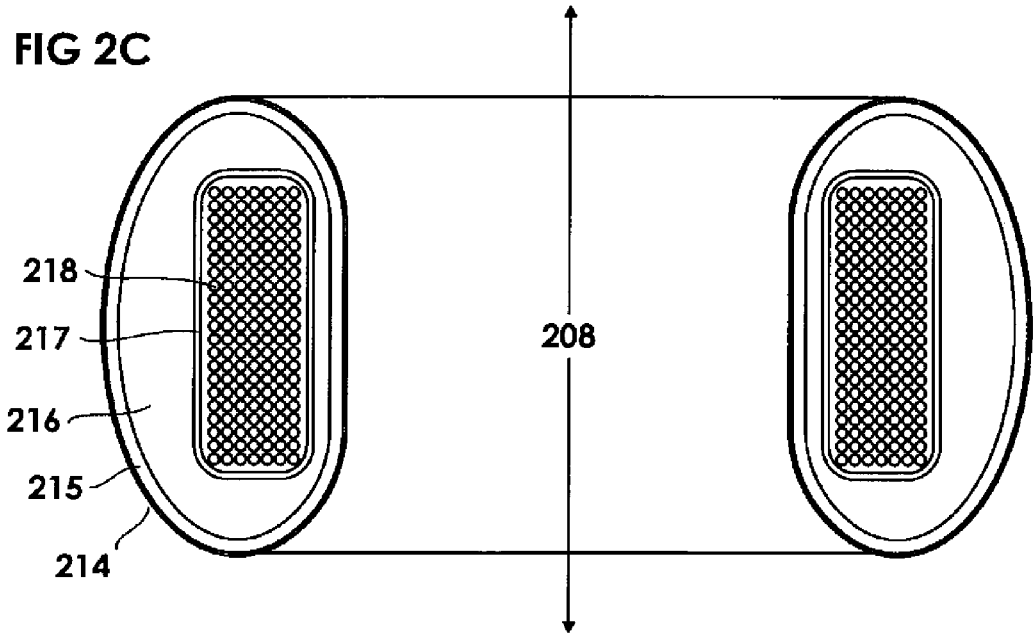
FIG. 2C is a cross-section of a solenoid-type magnetic with non-circular winding cross section and having coil container geometry that is conformal to the generated magnetic fields, characterized by a 'water droplet' shape, which is flattened on the face of the container within the bore of the coil.

In yet another embodiment, non-circular coil winding cross sections are illustrated such as the rectangular solenoid 218 pictured in FIG. 2C. In certain aspects, it is recommended that the cryostat/structural element 217 be of similar cross sectional geometry to that of the winding, but that all exterior layers such as thermal insulation 216 and one or more dielectric layers 215 be of similar cross sectional geometry to the field-conformal outer coil head container 214. As shown in FIG. 2C, the inward (bore-facing) face of the coil near axis of symmetry 208 is nearly flat in order to accommodate the substantially constant magnetic field in the bore of the magnet. The thickness of the thermal and electrical isolation layers must at all points be thicker than the minimum required for proper operation of the assembly.

The layout pictured in FIG. 2C will tend to transmit heat more rapidly on the inward face of the coil, creating differential heating of the coiling winding 218 and cryostat/structural element 217. This can be detrimental to assembly operation and lifetime if the heat flux is high. In the case of high heat flux, it may instead be preferable to use additional coil windings to shape the magnetic field to be conformal to the container shape, rather than vice versa.

Figure 3:
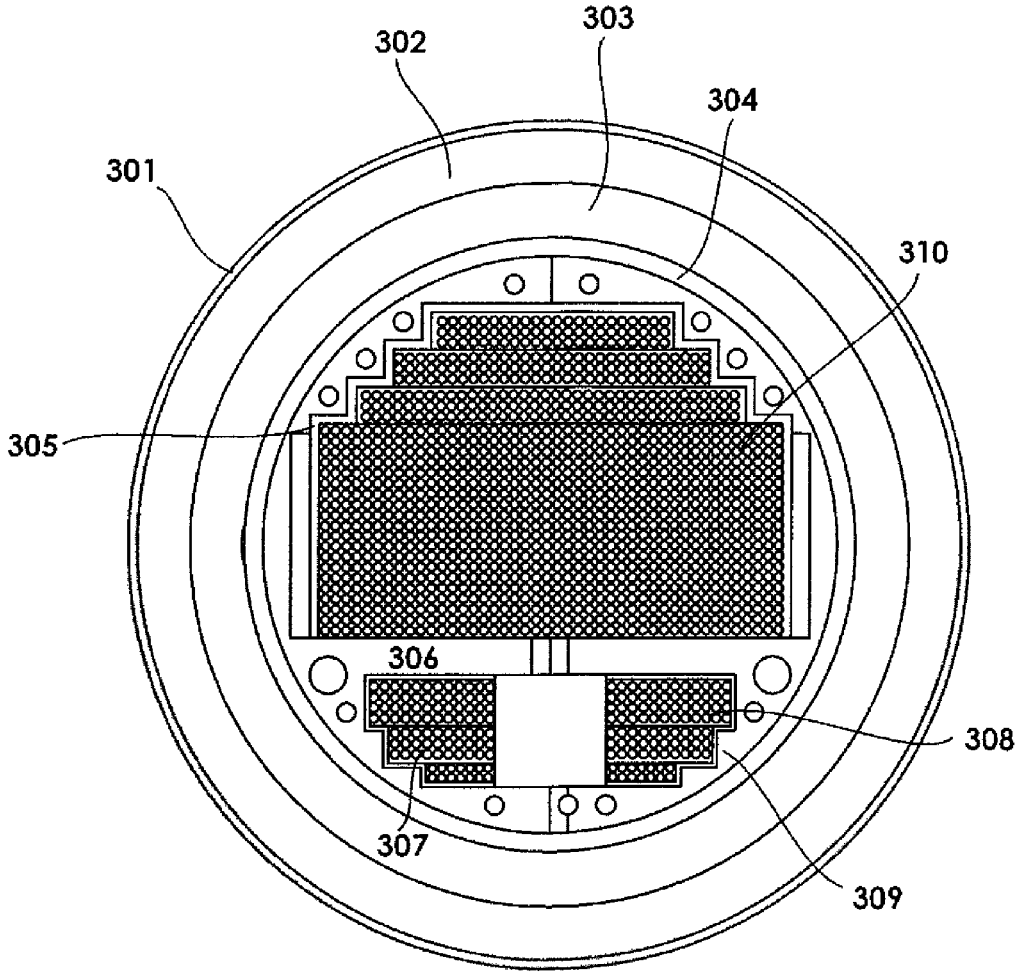
FIG. 3 depicts a minor radius cross section having multiple windings that is appropriate for use in toroidal or polygonal embodiments of the present invention. The multiple windings may be wired in parallel to provide a uniform current density, or at varied currents (complimentary to or opposing the primary winding) to control the shape of the magnetic field at the exterior of the coil housing.

FIG. 3 shows the minor-radius cross section of a coil head using this concept. The outer coil head container 301 is approximately circular, as is the one or more dielectric layers 302 and thermal insulation layer 303. The primary coil winding 310 is composed of a group of three rectangular windings nested together within a structural element 305. Two small 'bucking coils' composed of superconductive windings 307 and 308 may be run at varying amperages to achieve a field conformal to the outer container (magnetic field lines are parallel to the container at the surface of the container) despite externally imposed fields by other coils or current flows. In arrays of coils, it may be preferable to adopt an elliptical rather than circular cross section for all elements. This is particularly prudent in the case of spherical arrays of coils in close proximity to one another. The bucking coils must be supported by a structural brace 306, which rigidly holds the primary and bucking coils.

Figure 4:
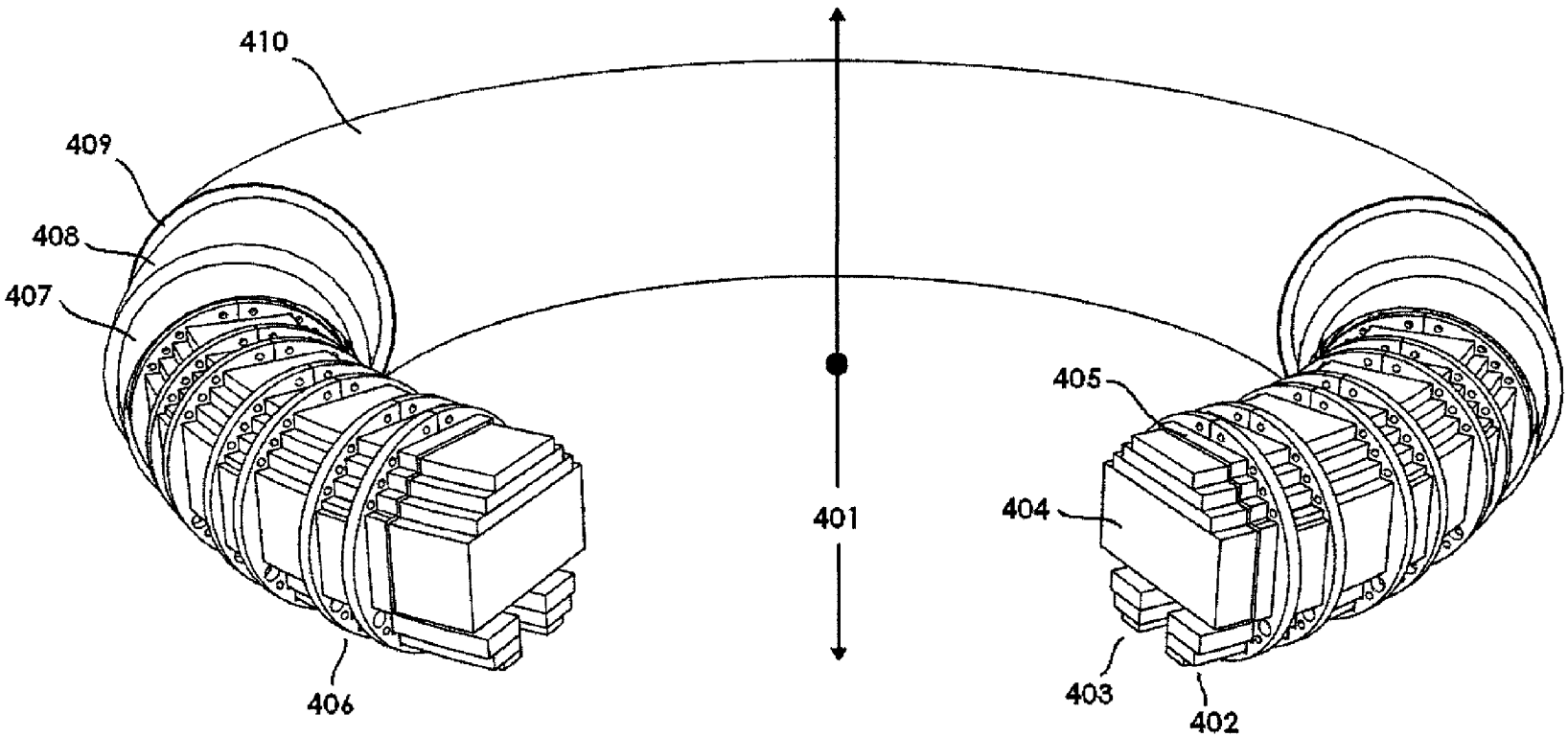
FIG. 4 is a cutaway of a toroidal coil head of an embodiment of the invention having minor radius cross section like that of FIG. 3.

Referring now to FIG. 4, a toroidal magnet having the cross section shown in FIG. 3 is depicted. The rectangular cross section coil winding 404 is symmetric about axis of symmetry 401, as are bucking coils 403 and 402. An array of structural braces 406 maintain the spacing of the primary and bucking coils despite the forces that are generated between them. A solid structural element 405 provides the primary rigidity of the assembly, upon which the cryostat/structural element 407, thermal isolation layer 408, one or more dielectric layers 409 and coil head container 410 are attached.

Figure 5A:
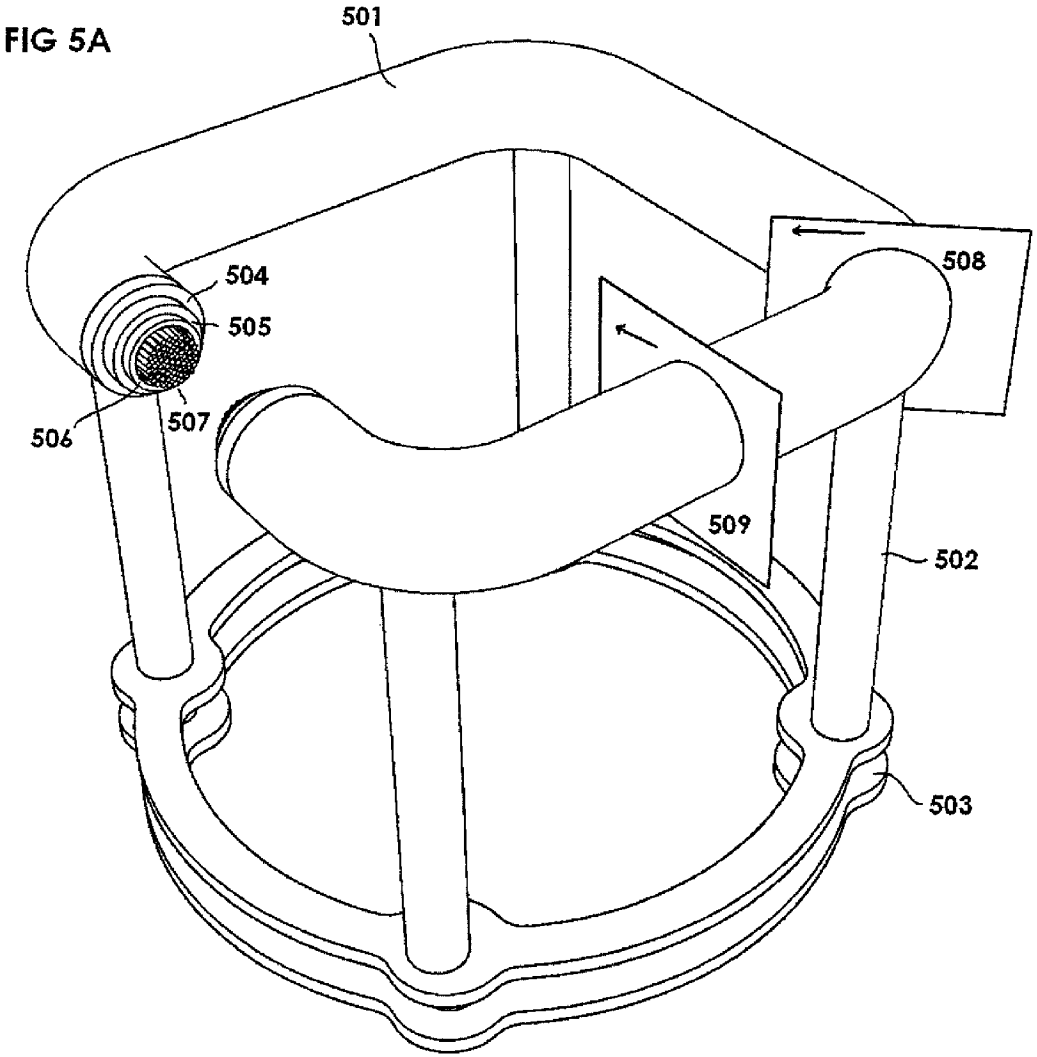
FIG. 5A is a cutaway of a polygonal (in this case, square) embodiment of the invention shown in perspective view.

For coils that are not circularly symmetric about an axis, the minor radius cross section for ideal field conformality is not constant along the length of the coil. FIG. 5A shows the cut away of a four-sided polygonal coil head container 501 mounted on a support base 503 with support rods 502. Coil winding 507 maintains a circular cross section along the length of the magnet, as does cryostat/structural element 506 and a thermal layer 505. The outer layers including the one or more dielectric layers 504 and coil head container 501 however have a non-constant cross section in order to maintain field conformality.

Figure 5B:
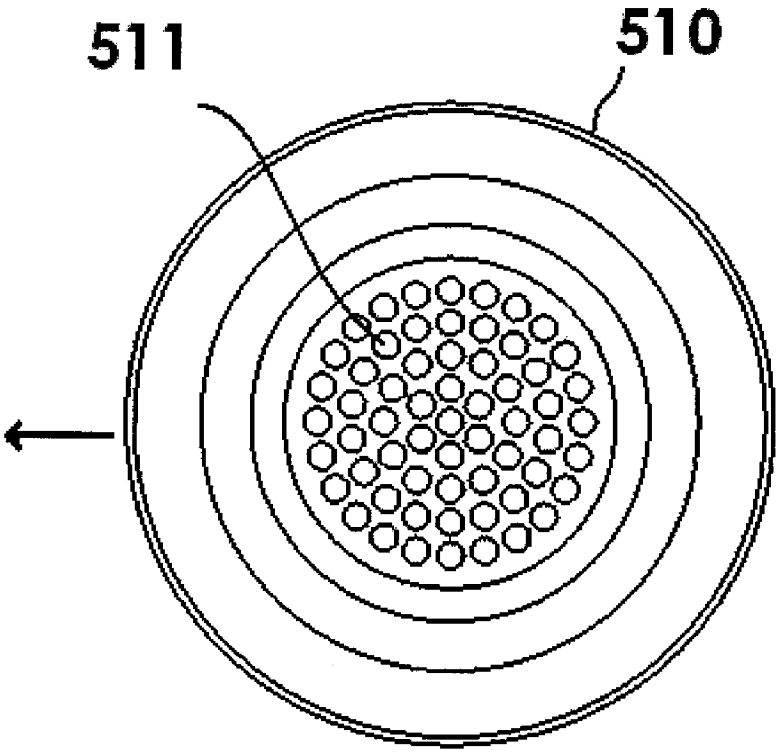
FIG. 5B shows the minor radius cross section appropriate for the generated magnetic field to be conformal to the container at a point mid-way along the straight section of the geometry shown in FIG. 5A, specifically at the plane marked 509.

At the cross section indicated by slicing plane 509 the preferred layout is that shown in FIG. 5B, wherein the circular cross section of the coil winding 511 is the same as that of the outer container 510.

Figure 5C:
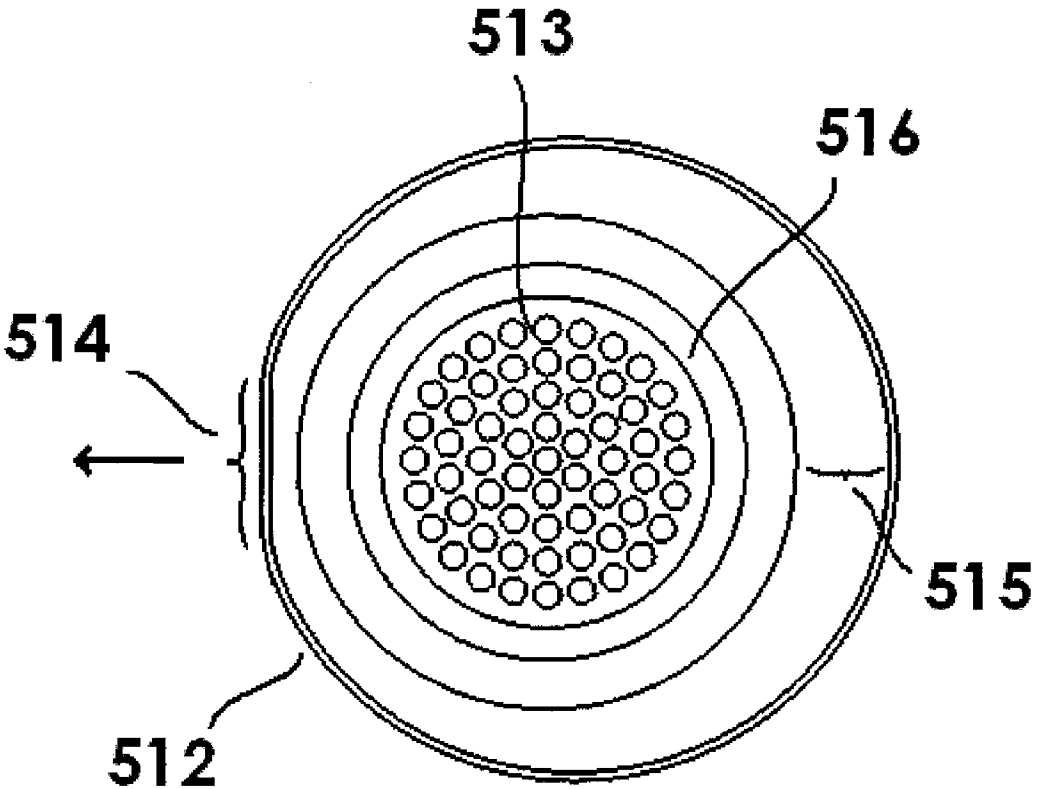
FIG. 5C shows the minor radius cross section appropriate for the generated magnetic field to be conformal to the container at the corner of the geometry shown in FIG. 5A, specifically at the plane marked 508.

At the corner as indicated by slicing plane 508 the layout must be altered to maintain field conformality, as reflected in FIG. 5C. The center of the roughly circular cross section coil winding 513 of the outer coil head container 512 is offset by some small distance 515 toward the outboard side of the coil (the extra width is opposite the direction of the arrow shown in FIG. 5C and further corresponds to the arrow in directional plane 508 shown in FIG. 5A). Further, a short section of the inboard side 514 of the cross section of the slicing plane 508 is flattened, resulting in a shorter radius from the center of the superconductive winding. Cross sections in between these two planes are linear combinations of the two extremes, so that there is no discontinuity along the surface of the coil. A cryostat/structural element 516 surrounds and supports the superconductive winding 513 and may also provide flow channels for cooling purposes.

Figure 6:
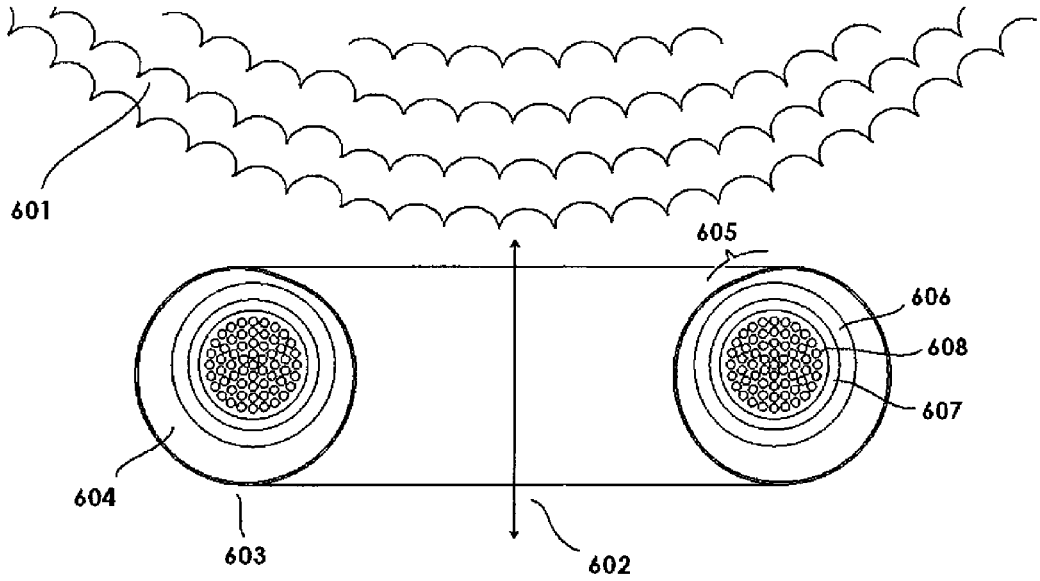
FIG. 6 depicts the cross section of circular coil that is conformal to the superposition of the generated magnetic fields and those due to a nearby diamagnetic plasma. This is characterized by on offset or elongation of the outer coil container along a line connecting the center of the minor radius and the divergence vector of the magnetic field at the surface of the plasma.

Referring now to FIG. 6, the cross section of a coil head designed for field conformality in close proximity to diamagnetic plasma 601 is depicted. The cross section of the central superconductive winding 608 is circular, and if the coil in question is a dipole, symmetric around axis 602. The cryostat/structural element 607 and thermal insulation 606 are also circular in cross section, and are concentric with the winding. The one or more dielectric layers 604 is offset along a line normal to the surface of the plasma/field boundary at the coil edge and slightly elliptical to accommodate field-conformal coil head container 603, which is similarly offset. If the field-line compression due to the diamagnetic plasma is great enough, a small flat section on the plasma-facing side of the coil 605 should be included to ensure field conformality with the container.

Figure 7:
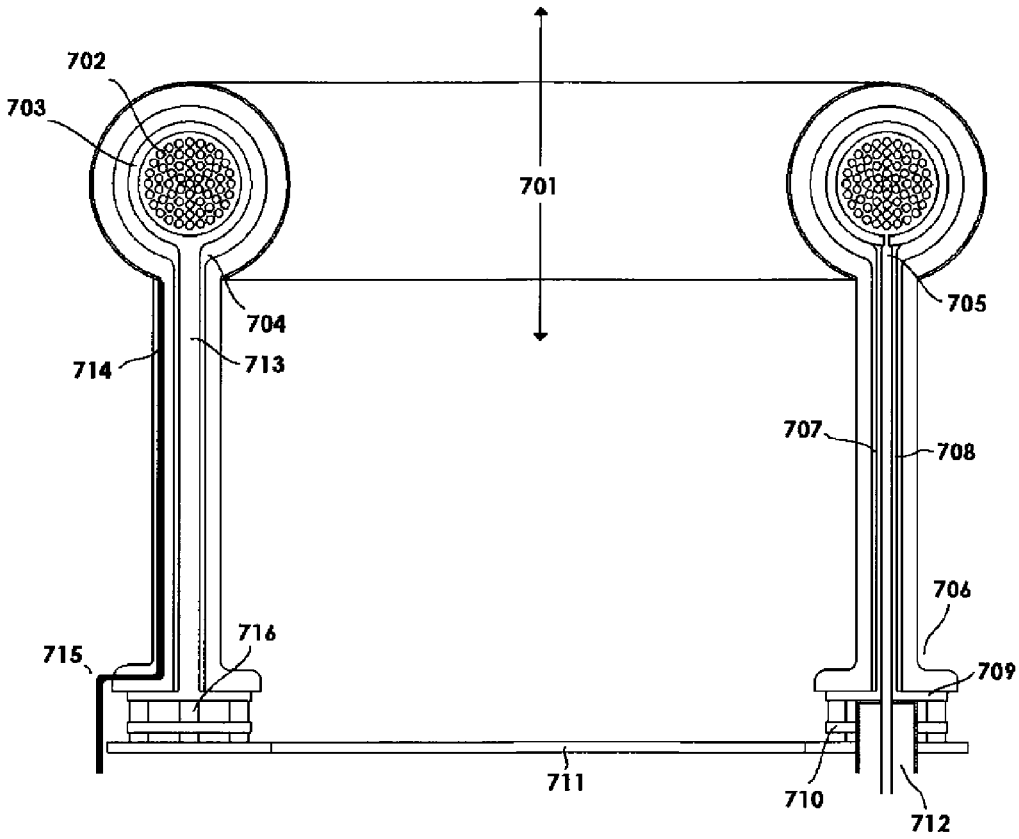
FIG. 7 shows the cross section of a toroidal system, including the location and design of power supply lines and thermal/electric isolation components.

Referring now to FIG. 7, the cross section of the coil head, supports and feedthroughs of an embodiment of the invention is shown. A circular superconductive coil winding 702 is symmetric around the axis 701, while the supports are arranged as shown in FIG. 1. The cryostat/structural element 703 is attached rigidly to solid support strut element 713 on two of the supports, and to hollow support strut element 708 on the others, which houses the supply conduits 705 for coolant and power to the winding. On all support struts are thermal insulation layers 707 and dielectric shields 706, which extend into a bell-shaped cover for the strut mount plates 709 the cold ring 710 and warm ring 711 provide structural rigidity, while thermal standoffs 716 composed of low-thermal conductivity materials (surface-fused aerogels with isolated steel reinforcements in one embodiment) isolate the cold ring thermally. On the supply-conduit housing legs, the vacuum-insulated feedthrough element 712 contains the conduit after passing below the cold ring. One of the three support struts houses high voltage line 714, which either drains away accumulated charge from charged particle impacts on the coil head container, or is used to bias the coil head container to some desired electrical potential (voltage). The high voltage line is electrically isolated using glass fibers, and is imbedded below the surface of the dielectric support strut armor 706 until it exits at point 715.

Figure 8A:
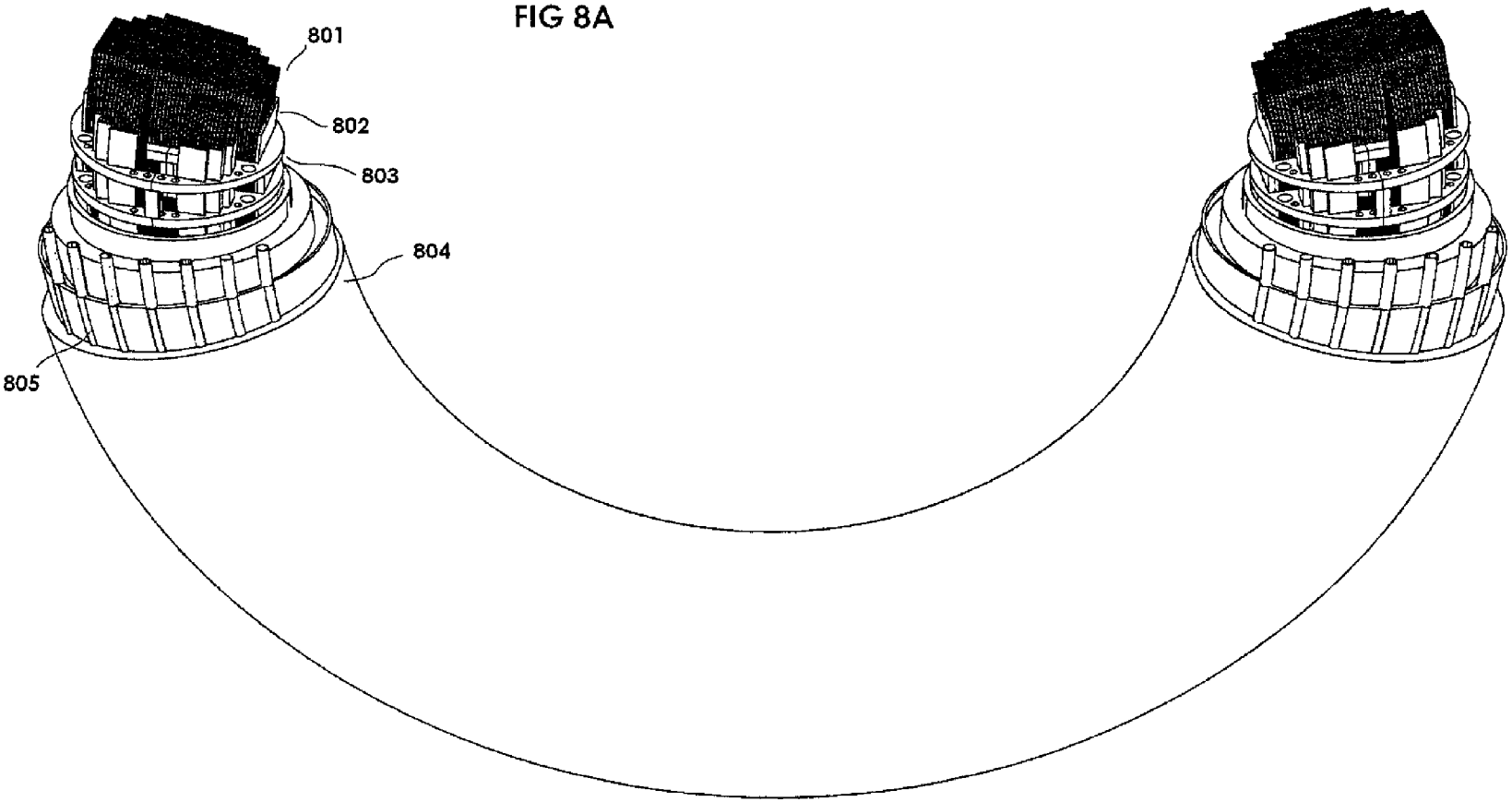
FIG. 8A is a cut-away of a coil head having a bottom-mounted ancillary cooling system for operation of the present invention under high external heat flux.
Figure 8B:
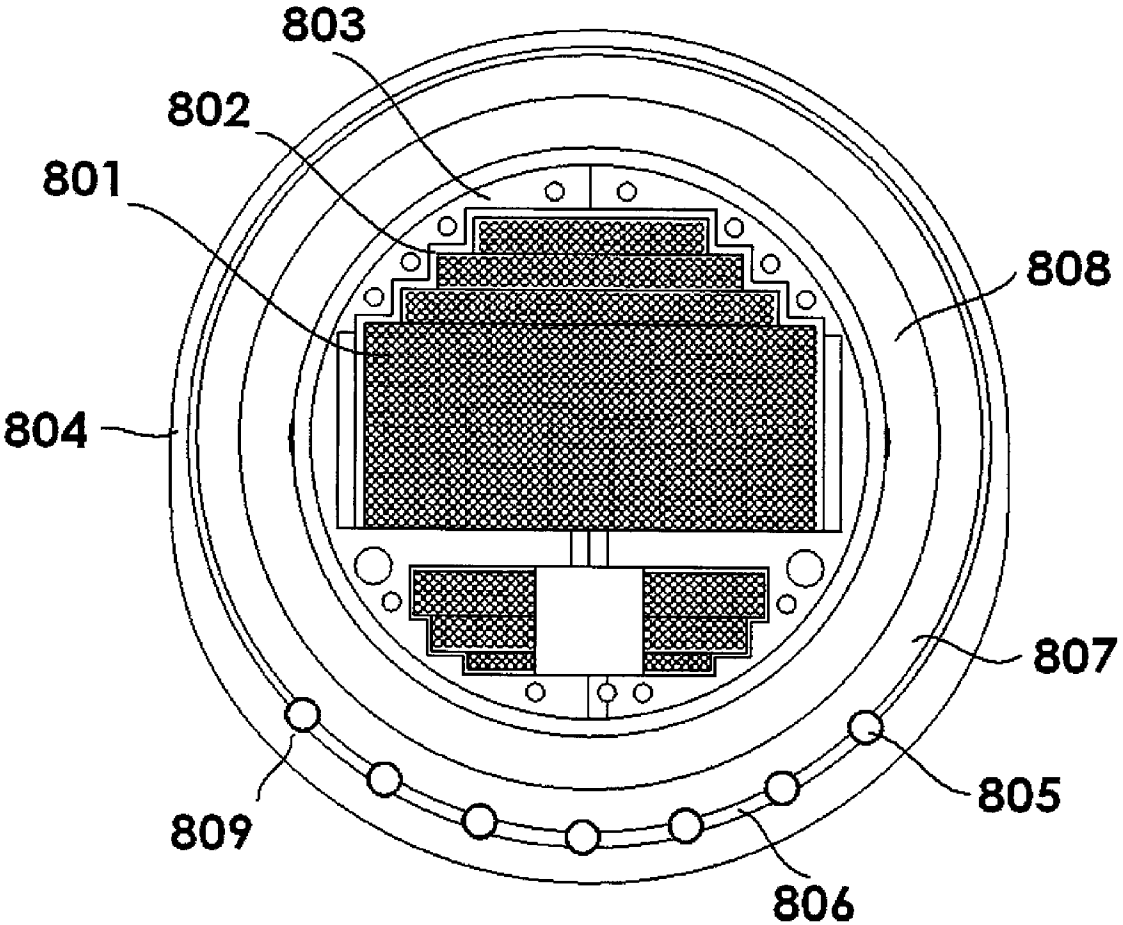
FIG. 8B shows a detail view of the minor-radius cross section of the geometry shown in FIG. 8A.

FIG. 8A shows a cutaway detail of a circular coil having an ancillary cooling system similar to that shown in FIG. 1. Coil winding 801 is supported by structural supports 802 and braces 803, while a series of coolant lines 805 provides near-room temperature cooling from the coil container 804. A two dimensional cross section of the minor radius of the coil, depicted in FIG. 8B shows that this ancillary cooling system is outside of the primary thermal blanket 808, and thus reduces the thermal load on the insulation systems by reducing the equilibrium temperature of the outside of the thermal insulation layer, which reduces the rate of heat transfer into the coil windings. This is accomplished by running fluid 805 of the previously described types through lines located in between the dielectric layer and the outer coil container 809. In this embodiment, these lines are located only on the bottom of the coil and conduction is counted on for heat flux incident on the top of the coil to be transmitted to the coolant. This is achieved by two means—first, the outer coil container 804 is thicker on the bottom of the coil than on the top, leading to enhanced heat transfer due to the greater heat capacity of the lower section. Second, a layer 806 having very high heat conductivity, such as copper in one embodiment, is attached to the coolant lines, and extends to the top of the coil. In other embodiments the coolant lines may be located along the entire surface of the coil, rather than only over part of the surface as in this embodiment. In applications of particularly extreme heat flux, it may be necessary to have a plurality of ancillary cooling systems, each separated by a thermal insulation layer. In one embodiment, the equilibrium surface temperature could be as high as is possible based on materials concerns (somewhere around 2,500 K for tungsten) as long as sufficient ancillary coolant systems are present to prevent the outer surface of the primary insulation layer from exceeding approximately 70 C (343K).

Figure 9:
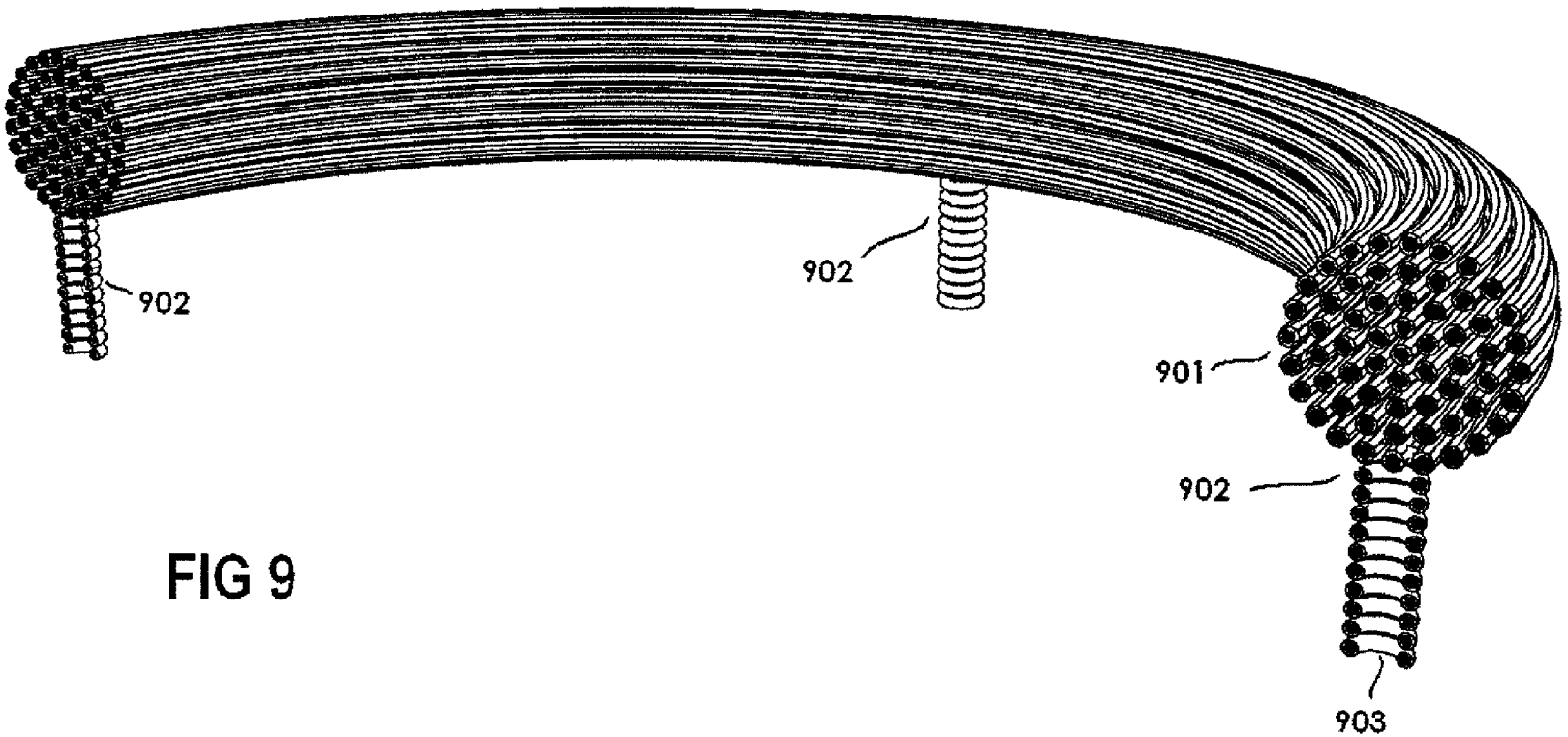
FIG. 9 is a cutaway showing the arrangement of current carrying coils appropriate for shielding rear-mounted supports of a toroidal coil winding from charged particle impact.

A second type of bucking coil arrangement is shown in cut away detail in FIG. 9. This coil winding arrangement is designed to allow partial field conformality between the generated fields and the support rods, reducing the frequency of charged particle impacts on the dielectric armor of the support struts when housed near an energetic particle source or plasma. The primary coil winding 901 is flanked by small solenoid coils 902 that generate dipole fields along the axis of the support struts. The small solenoid coil windings must also be within the insulation, dielectric, and cooling elements just as the primary coil. A hollow region 903 is present to allow for the cryogenic coolant and power supply lines for the primary coils to be passed through.

Figure 10:
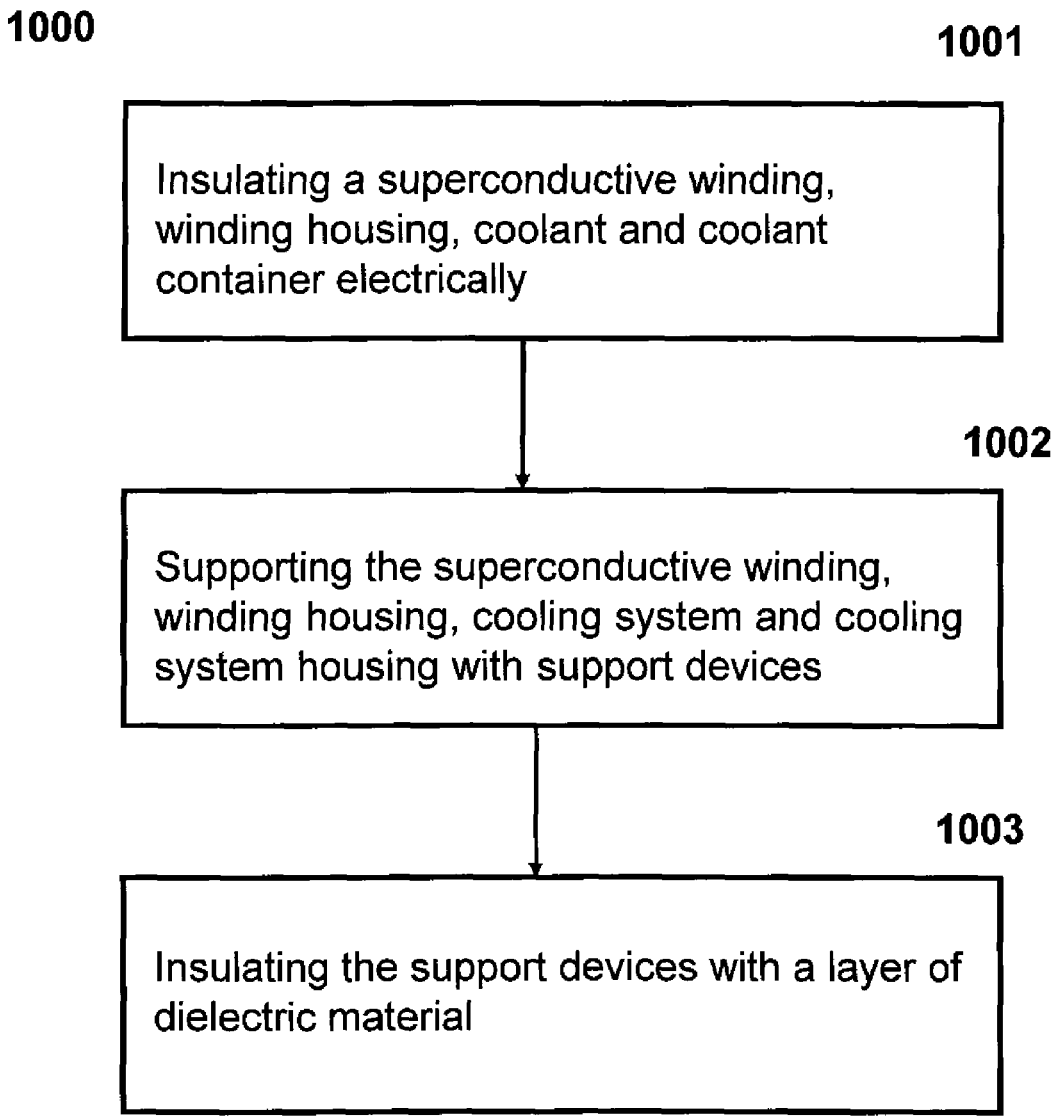
FIG. 10 is a method flowchart for providing electrical insulation and mechanical support of one or more superconductive magnets.

In another embodiment, a method of providing electrical insulation, thermal insulation and mechanical support of one or more superconductive electromagnets is provided, as shown in FIG. 10. A method of providing electrical insulation and mechanical support of one or more superconductive electromagnets 1000 comprises the following steps in any order, including: insulating a superconductive winding, winding housing, cryogenic cooling system and cooling system housing electrically 1001 with a layer of dielectric material having dielectric strength greater than the product of (1) and (2). In certain aspects, (1) is the electric potential difference between: (i) the superconductive winding, winding housing, cryogenic cooling system and cooling system housing; and, (ii) the outermost surface of the electrically conductive material surrounds the dielectric material that surrounds the superconductive winding, winding housing, cryogenic cooling system. In other aspects, (2) is the thickness of the dielectric material. In another step found in the method described above, supporting the superconductive winding, winding housing, cryogenic cooling system, and cooling system housing mechanically within a chamber by multiple support rods 1002, is provided such that the shortest distance between: (3) the outermost surface of the dielectric; and, (4) the innermost surface of the chamber wall is greater than the quotient of (5) and (6) below. In some aspects, (5) is the electric potential difference between: (i) the superconductive winding, winding housing, cryogenic cooling system and cooling system housing; and (ii) the outermost surface of the dielectric material housing. In another step, insulating the support rods with a layer of dielectric material 1003 is provided. In other various aspects, (6) is the effective dielectric strength of the medium surrounding: (i) the outermost surface of the dielectric material housing; (ii); and insulating the support rods with a layer of dielectric material having dielectric strength greater than the product of the first voltage and the thickness of the dielectric layer.

Figure 11:
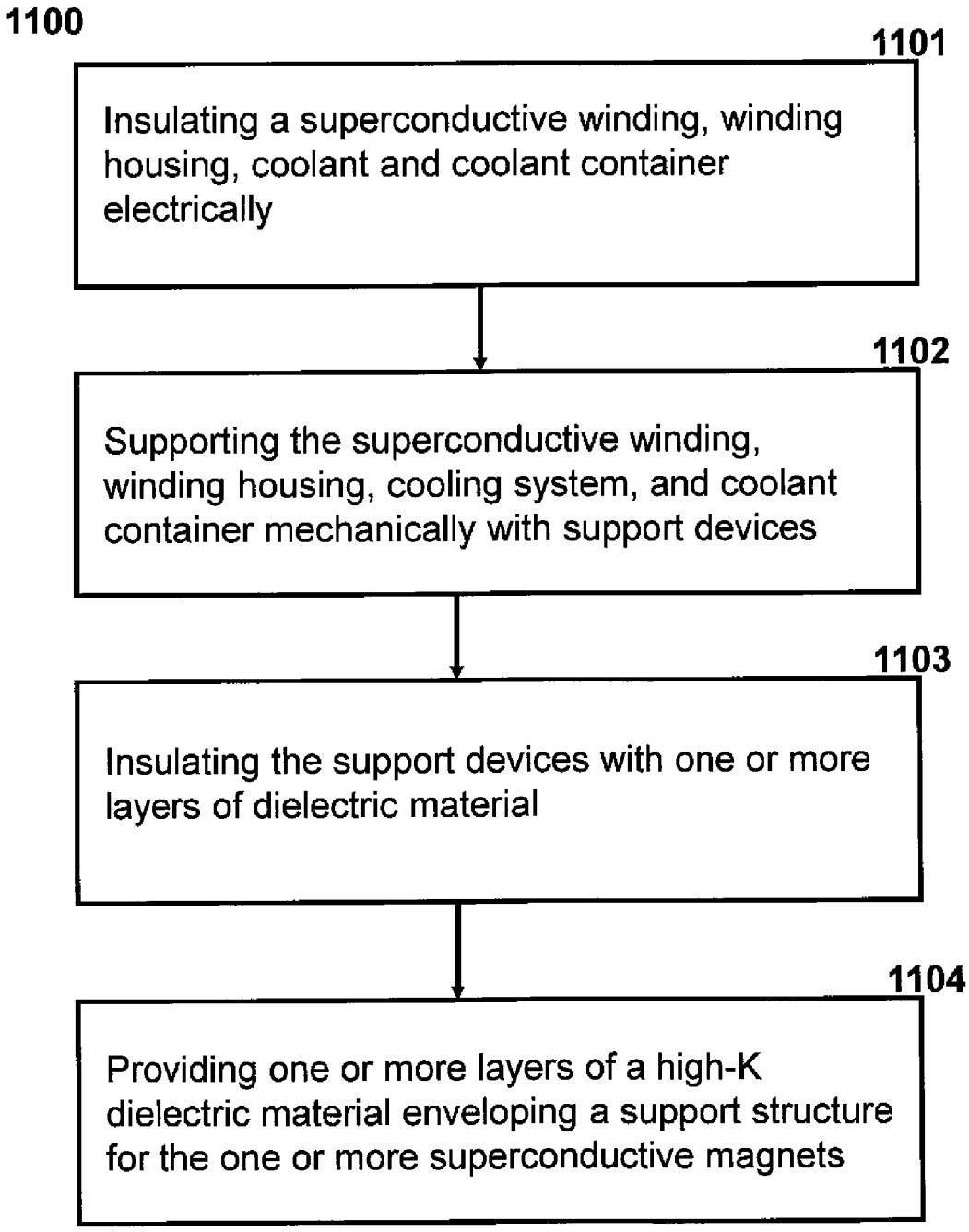
FIG. 11 is a method flowchart further including additional steps for providing electrical insulation, mechanical support of one or more superconductive magnets and dielectric insulation.

In another embodiment as shown in FIG. 11, a method of providing electrical insulation, thermal insulation and mechanical support of one or more superconductive electromagnets 1100 further includes, in addition to all of the steps as shown in FIG. 10, providing one or more innermost layers of high-K dielectric material 1104. In certain aspects, the one or more layers of high-K dielectric materials may be coupled to a structural support structure for the coil which also functions as one or more flow channels for actively pumped cryogenic coolant; and providing one or more layers of vacuum impinged metalized woven polymeric fabric wrapping coupled with a flexible low density silica-based layer of thermal insulation that contains high reflectivity, low thermal conductivity material. In other various aspects, the one or more dielectric layers of high-K dielectric materials may form a structural support structure which functions in other embodiments in one or more of the configurations noted above.

Figure 12:
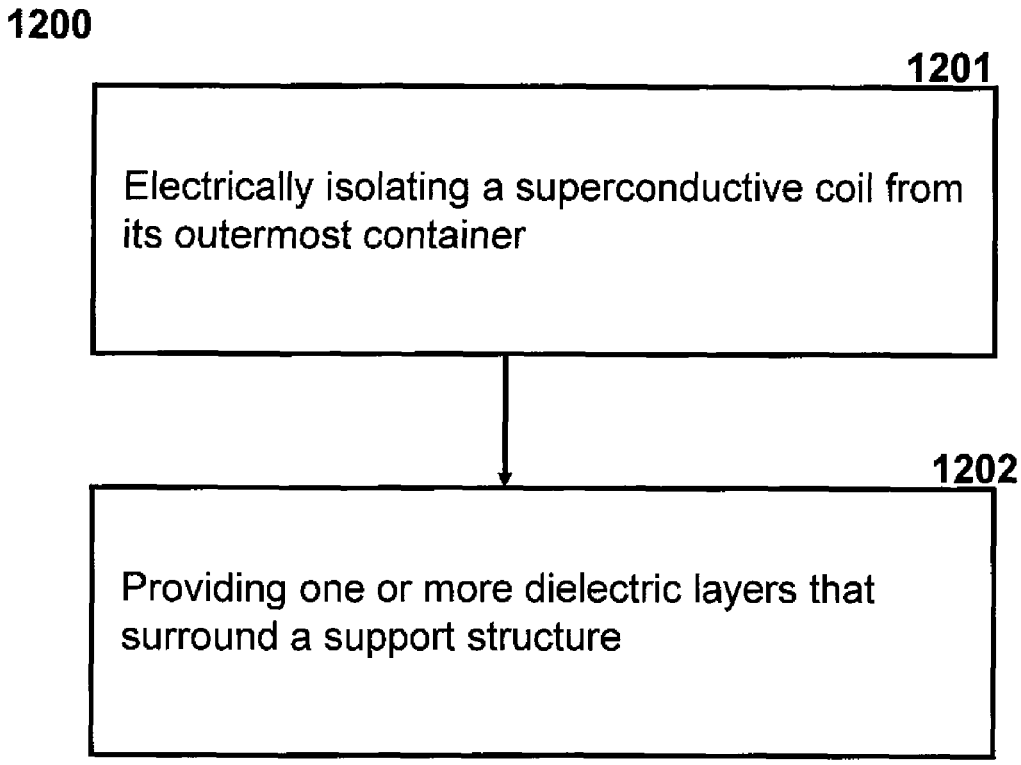
FIG. 12 is a method flowchart for providing electrical isolation between a superconductive magnet and its outermost container.

In another embodiment as shown in FIG. 12, a method of providing electrical insulation, thermal insulation and mechanical support of one or more superconductive electromagnets 1200 comprises the steps, in any order, of electrically isolating a superconductive coil from its outermost container 1201 and providing one or more dielectric layers that surround a support structure 1202.

Figure 13:
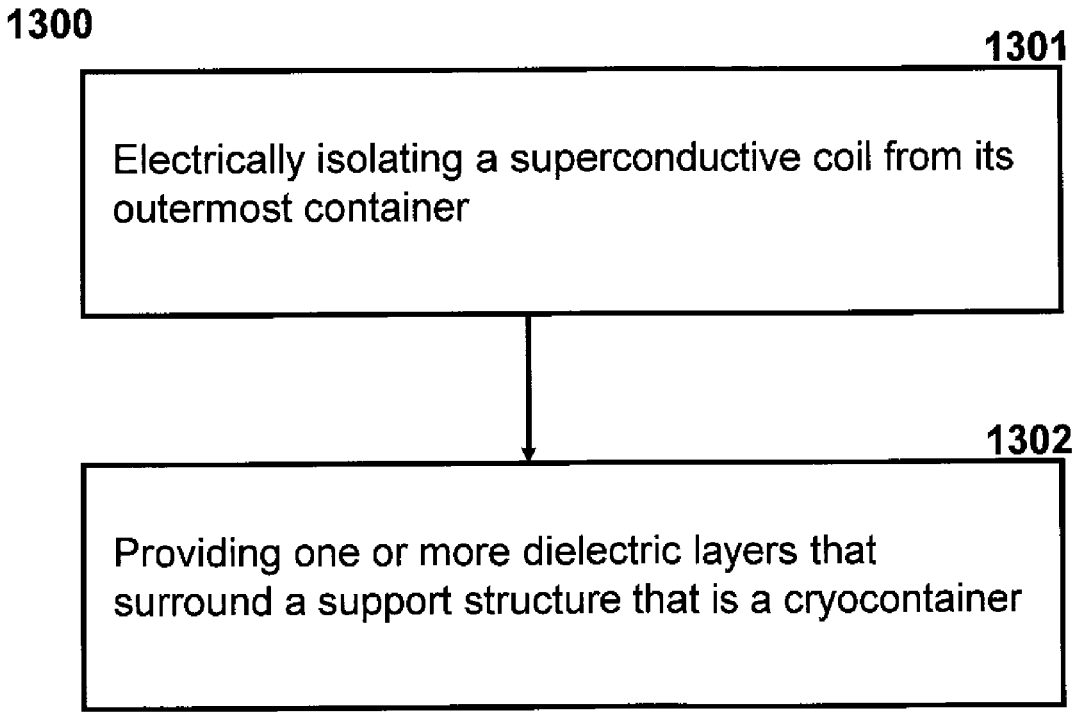
FIG. 13 is a method flowchart for providing electrical isolation between a superconductive magnet and its outermost container.

In other aspects as shown in the flow chart of FIG. 13, the method of FIG. 10 may be provided wherein the one or more dielectric layers that surround a support structure is a cryocontainer. In other various aspects, the one or more dielectric layers may themselves form a cryostat/structural element.

Figure 14:
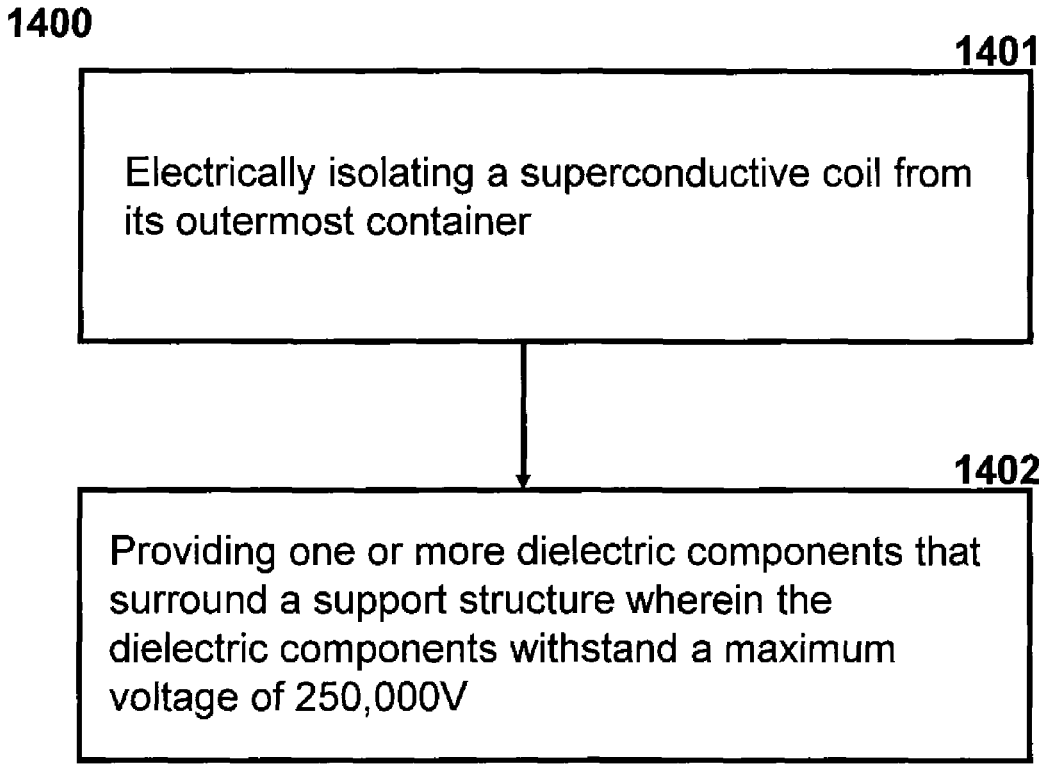
FIG. 14 is a method flowchart for providing electrical isolation between a superconductive magnet and its outermost container.

In other various aspects, as shown in FIG. 14, the method of FIG. 10 may be provided wherein one or more of the dielectric layers substantially withstand a maximum voltage of about 250,000V (250 kV).

Figure 15:
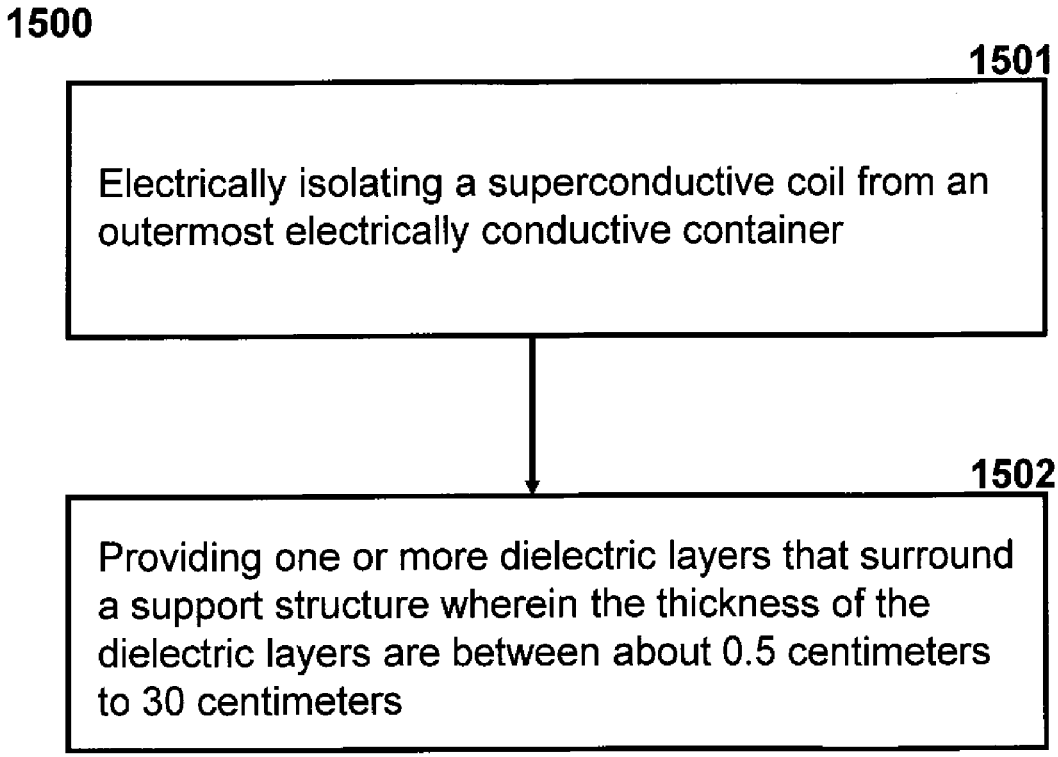
FIG. 15 is a method flowchart for providing electrical isolation between a superconductive magnet and its outermost container.

In certain aspects, as shown in FIG. 15, the method of FIG. 10 may be provided wherein one or more of the dielectric layers have a thickness of a minimum thickness of about 0.5 centimeters to a maximum thickness of about 50 centimeters.

Figure 16:
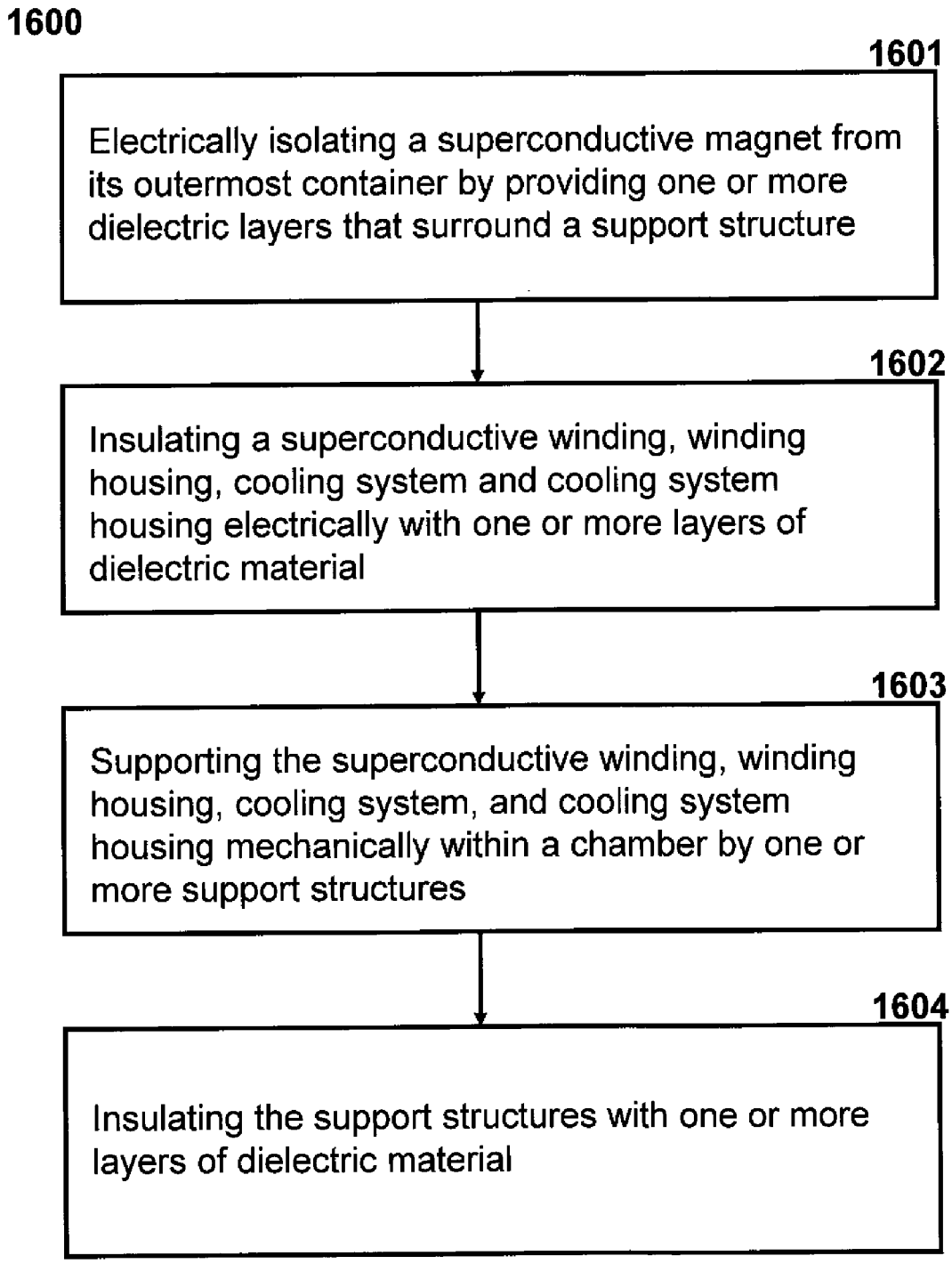
FIG. 16 is a method flowchart for providing electrical isolation, insulation, mechanical support and insulation of support rods for a superconductive electromagnet.

In yet another embodiment as shown in FIG. 16, a method 1600 for mechanical support, electrical isolation, and thermal insulation of one or more superconductive electric magnets that are supporting the superconductive electric magnet winding, winding housing, and cryogenic coolant is provided that includes the steps of FIG. 10 and further includes, in any order, electrically isolating a superconductive coil from its outermost container by providing one or more dielectric layers that surround a support structure 1601, insulating a superconductive winding, winding housing, cooling system and cooling system housing electrically with a layer of dielectric material 1602, supporting the superconductive winding, winding housing, cooling system, and cooling system housing mechanically within a chamber by multiple support rods 1603, and insulating the support rods with a layer of dielectric material 1604.

Figure 17:
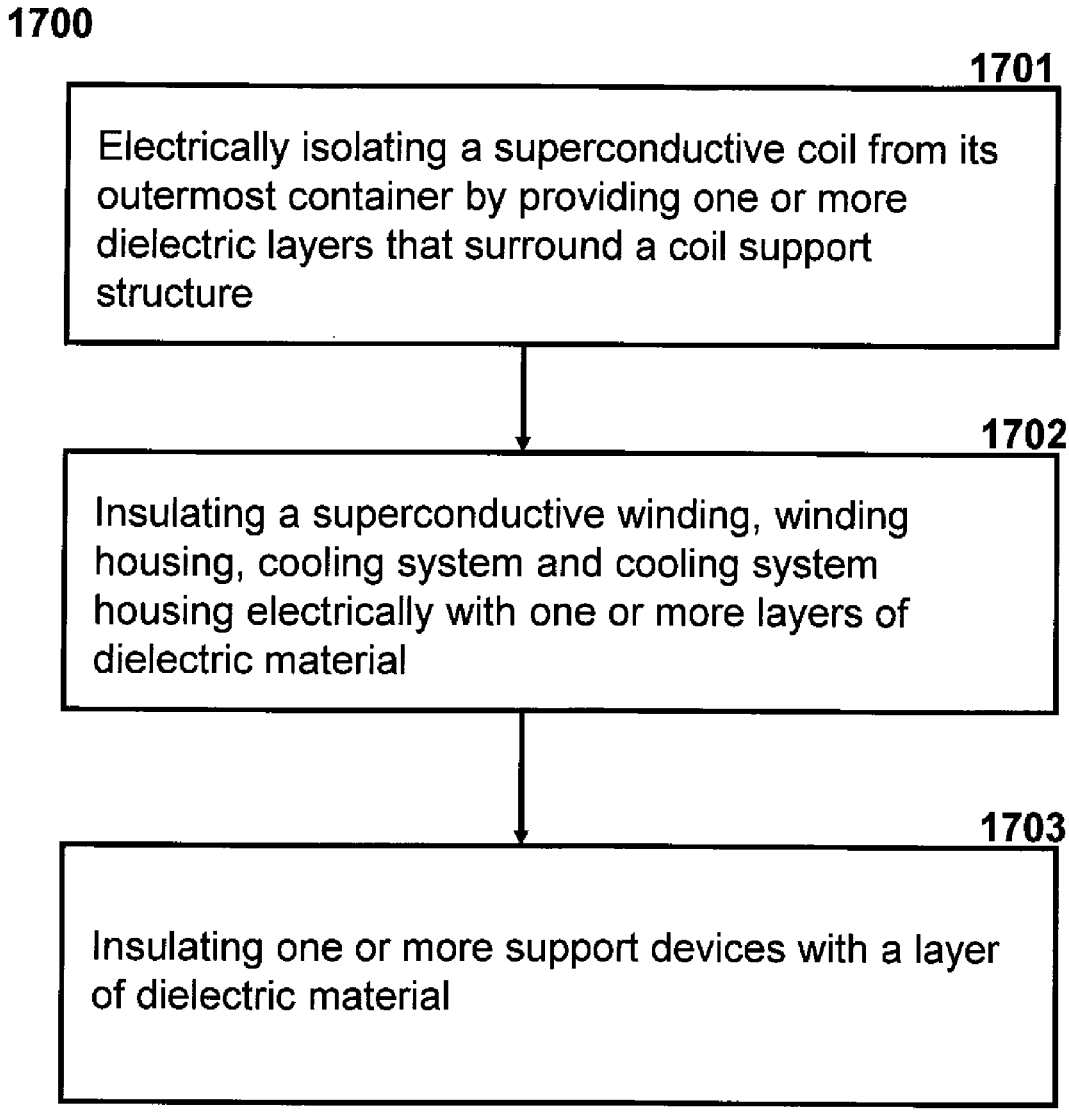
FIG. 17 is a method flowchart for providing electrical isolation and insulation of a superconductive magnet and its support structure.

In another embodiment as shown in FIG. 17, steps 1700 for isolating, supporting and insulating the superconductive winding, winding housing, cooling system, and cooling system housing include electrically isolating a superconductive coil from its outermost container by providing one or more dielectric layers that surround a support structure 1701, insulating a superconductive winding, winding housing, cooling system and cooling system housing electrically with a layer of dielectric material 1702, and insulating the support rods with a layer of dielectric material 1703. In certain aspects, the support structures may be support rods. In other various aspects, the chamber may comprise one or more dielectric layers to form a support structure.

Figure 18:
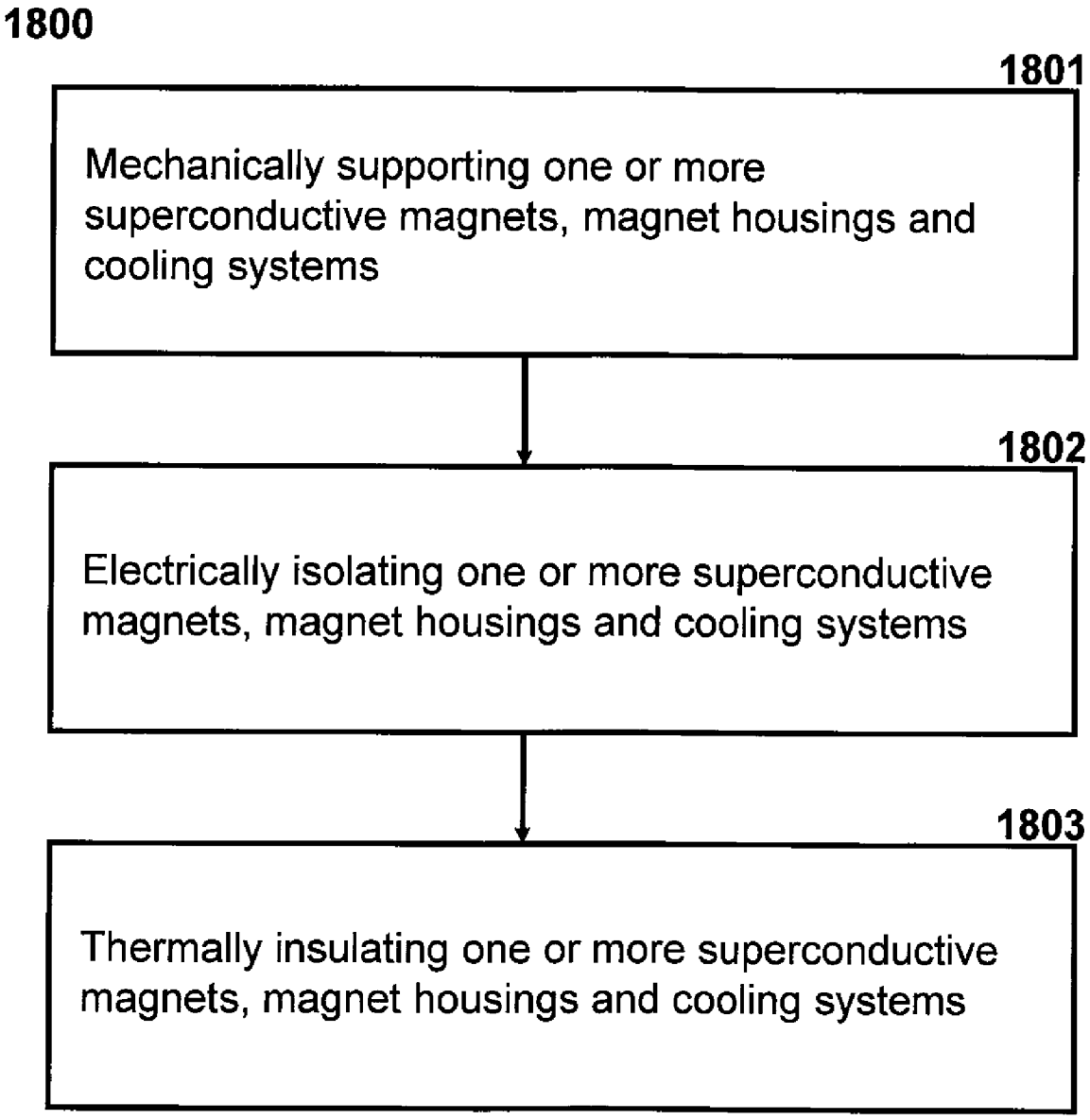
FIG. 18 is a method flowchart for providing mechanical support, electrical isolation and thermal insulation of one or more superconductive magnets.

In another embodiment as shown in FIG. 18, steps 1800 for tri-isolating, the superconductive winding, winding housing, cooling system, and cooling system housing include mechanically supporting one or more superconductive windings, winding housings and cooling systems 1801, electrically isolating the superconductive winding, winding housing and cooling system 1802, and thermally insulating one or more superconductive magnetic coils 1803.

Figure 19:
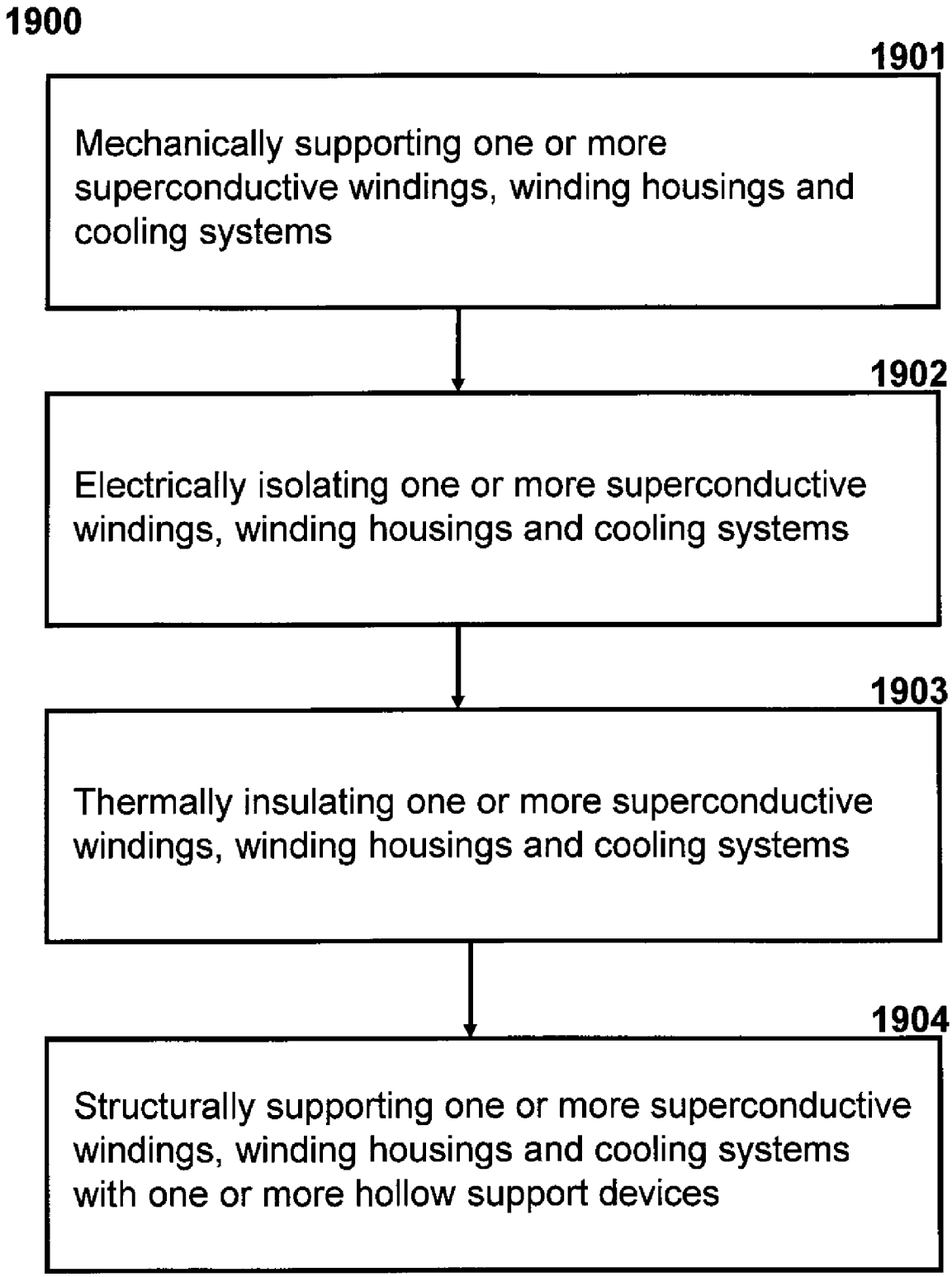
FIG. 19 is a method flowchart further including additional steps for providing mechanical support, electrical isolation and thermal insulation of one or more superconductive magnets.

In another embodiment as shown in FIG. 19, the steps of FIG. 10 further include: structurally supporting a winding housing by one or more hollow struts 1904. In certain aspects, the method may utilize structural elements that include a cavity through which supply conduits may flow.

Figure 20:
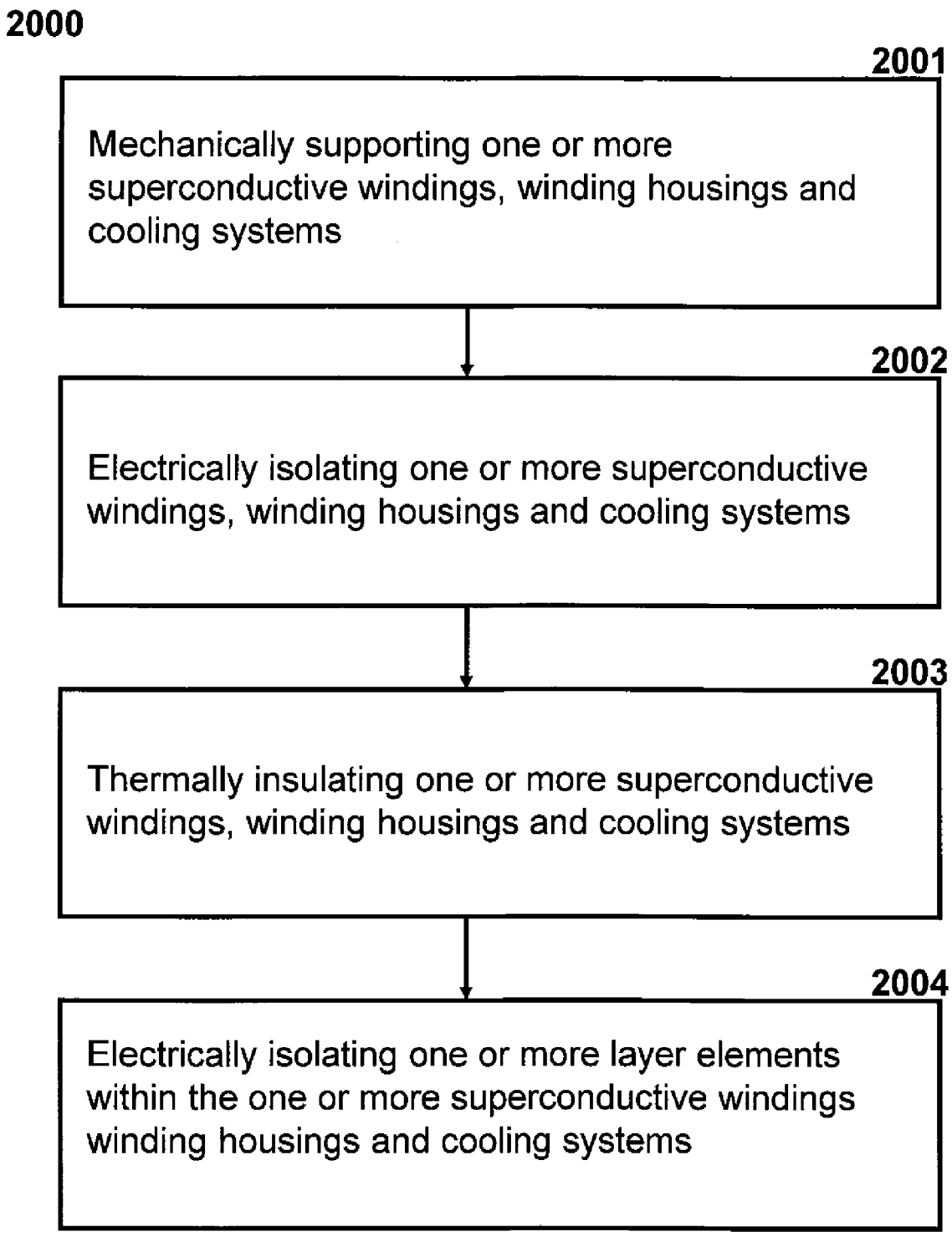
FIG. 20 is a method flowchart further including additional steps for providing mechanical support, electrical isolation and thermal insulation of one or more superconductive magnets.

In other various aspects as shown in FIG. 20, the method may further include steps, in any order for isolating one or more layer elements including a toroidial section of dielectric composed of an upper and lower half 2004.

Figure 21:
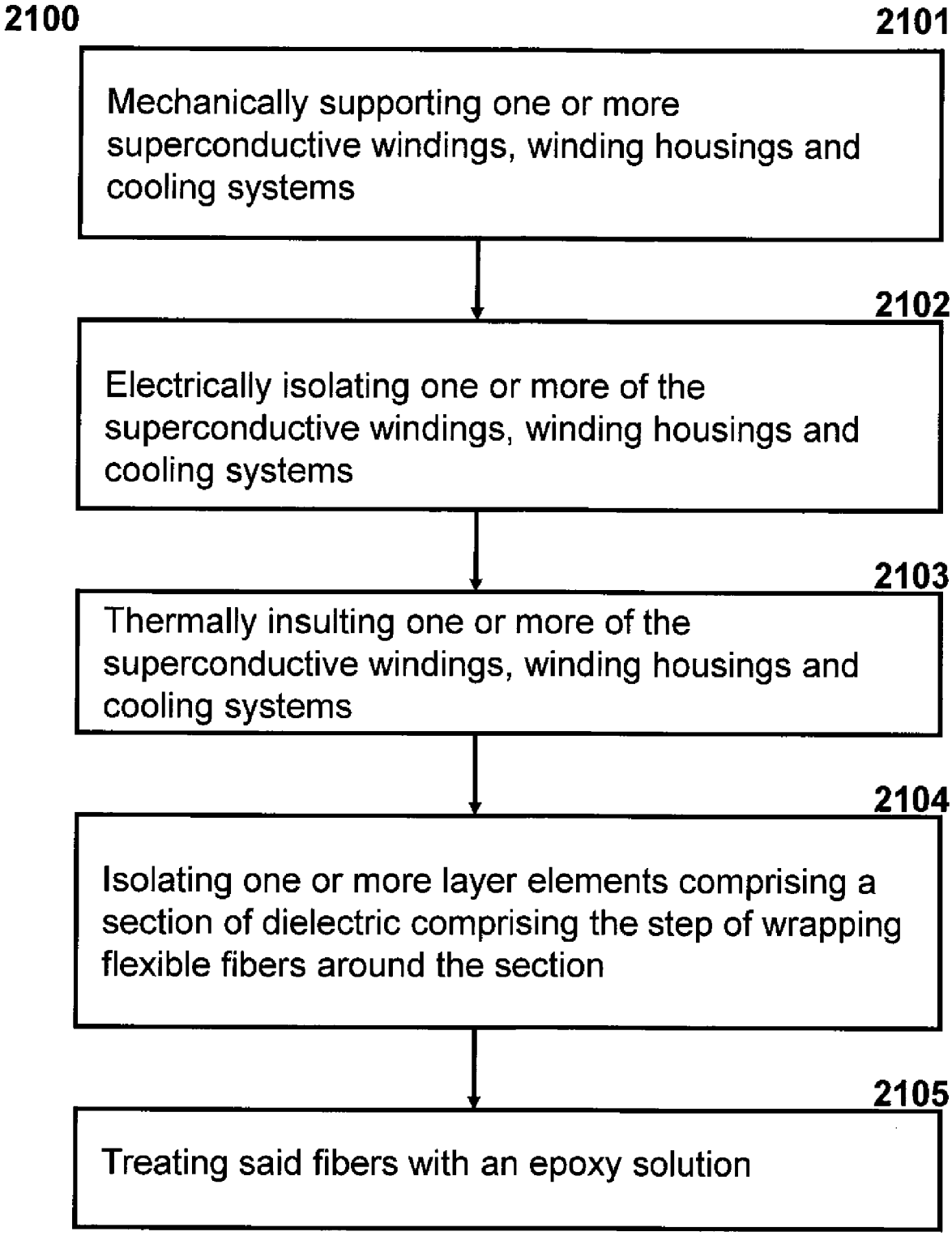
FIG. 21 is a method flowchart further including additional steps for providing mechanical support, electrical isolation and thermal insulation of one or more superconductive magnets.

In other various aspects as shown in flow chart in FIG. 21, the method may further include, in addition to the steps shown in FIG. 20, a method is provided for treating the fibers with an epoxy solution 2105.

Figure 22:
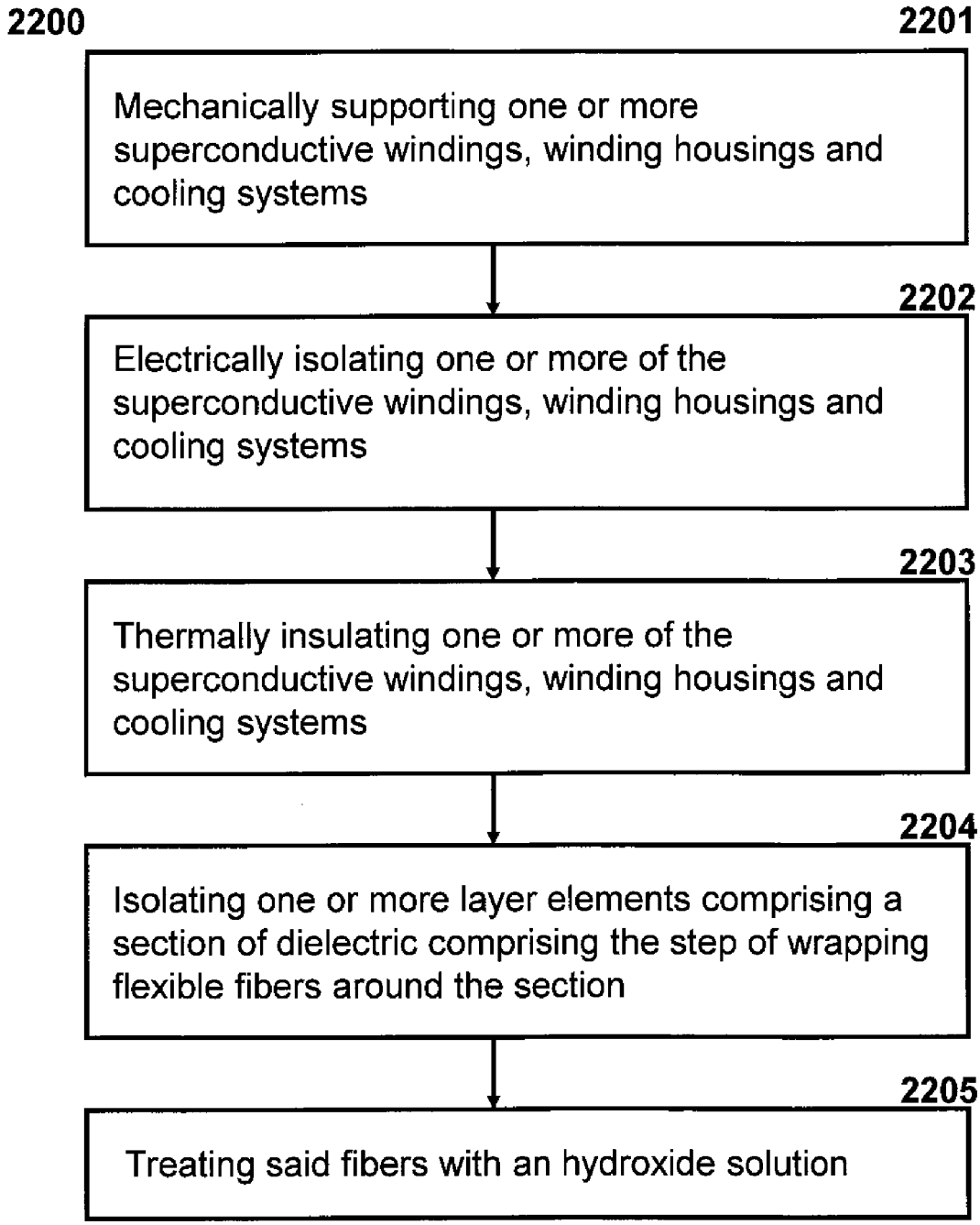
FIG. 22 is a method flowchart further including additional steps for providing mechanical support, electrical isolation and thermal insulation of one or more superconductive magnets.

In other various aspects as shown in FIG. 22, the method may variously include, in addition to the steps in FIG. 20, treating the fibers with a silicate hydroxide solution 2205.

Figure 23:
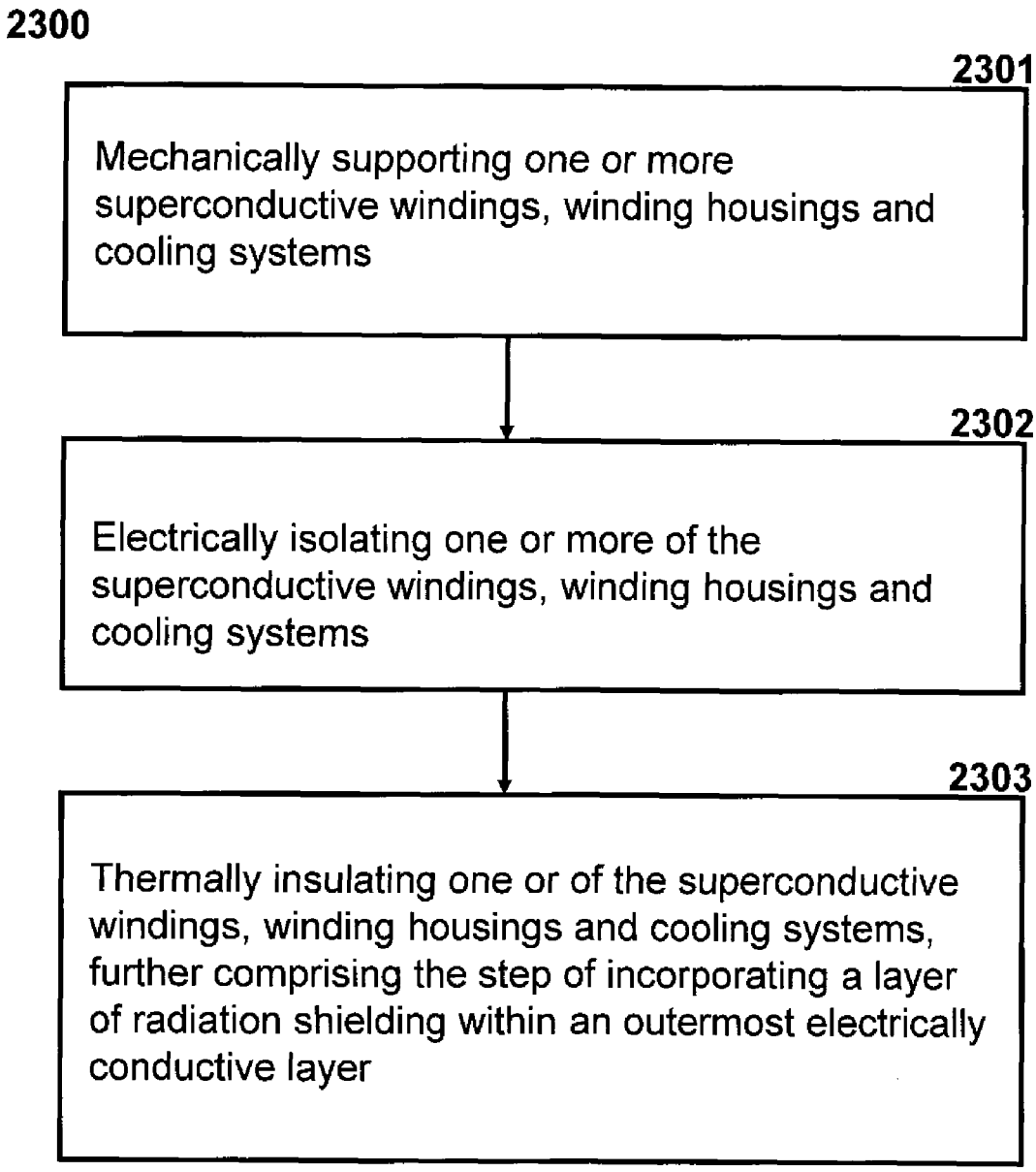
FIG. 23 is a method flowchart for providing mechanical support, electrical isolation and thermal insulation of one or more superconductive magnets.

Finally, an alternative embodiment is provided, as shown in FIG. 23, in which the step of thermally insulating one or more superconductive magnetic coils is included wherein a layer of radiation shielding between the outer layer and the dielectric layer is provided 2303. In addition, the method may also include, in any order, a step for mechanically supporting one or more superconductive windings, winding housings and cooling systems 2301, and electrically isolating the superconductive winding, winding housing and cooling system 2302.

Figure 24:
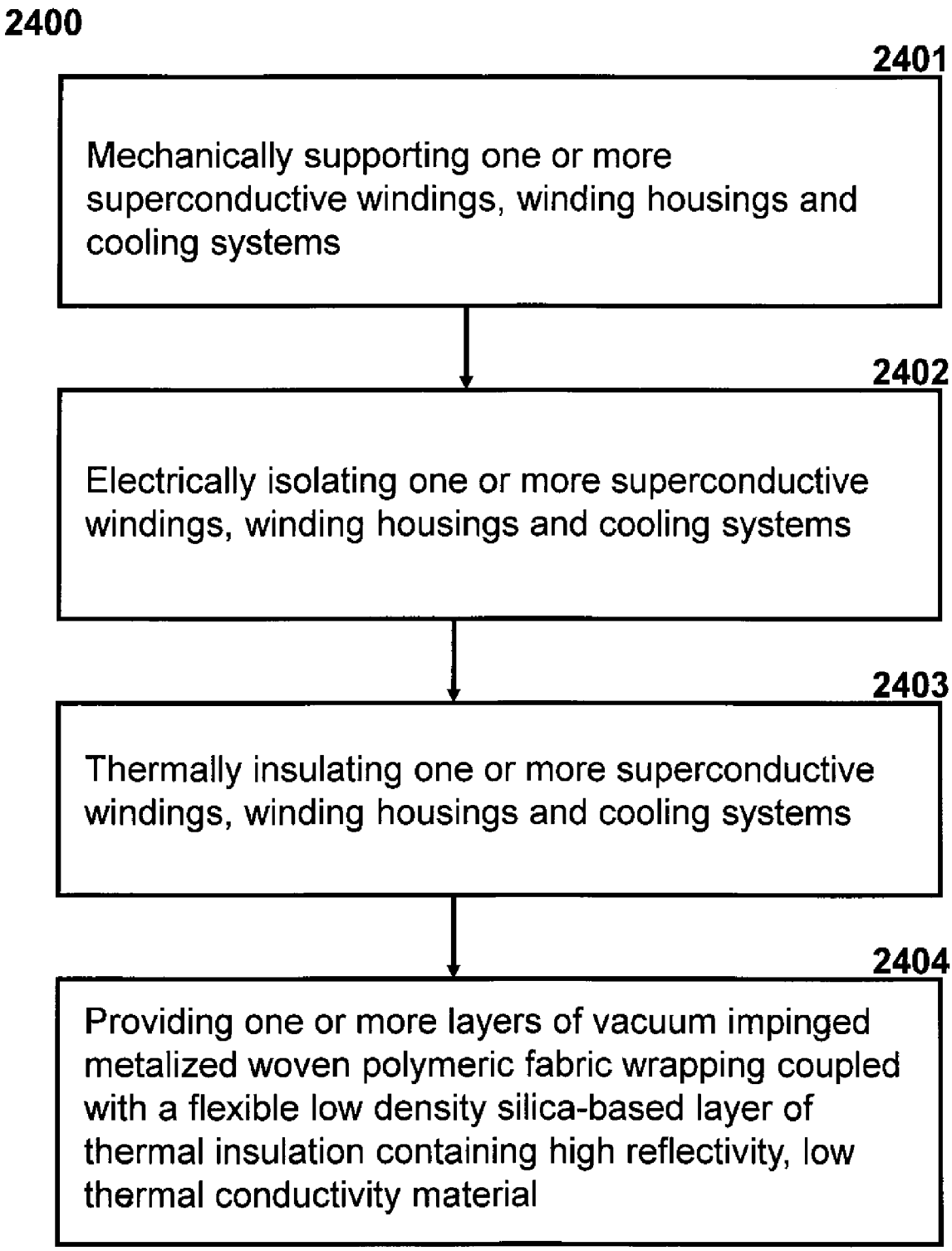
FIG. 24 is a method flowchart further including additional steps for providing mechanical support, electrical isolation and thermal insulation of one or more superconductive magnets.

In yet another embodiment as shown in FIG. 24, a method includes, in addition to the steps in any order shown in FIG. 18, steps for providing one or more layers of vacuum impinged metalized woven polymeric fabric wrapping coupled with a flexible low density silica-based layer of thermal insulation containing high reflectivity, low thermal conductivity material.

In yet another embodiment, an apparatus is configured with a superconductive magnetic coil that has three layers. The first layer is made of a high-K dielectric material. The second layer is made of a vacuum impinged fabric wrapping providing one or more layers of vacuum impinged metalized woven polymeric fabric wrapping coupled with a flexible low density silica-based layer of thermal insulation containing a high reflectivity and low thermal conductivity material. The third layer is made of a thermal insulation. The superconductive magnetic coil of the apparatus can have a layer of high-K dielectric material that includes individual filaments contained in a copper matrix or even a larger cable comprised of multiple braided filaments and additional binding material. Finely, an alternative to this apparatus embodiment has a winding of cable-in-conduit Rutherford cables. These cables have superconductive filaments in a copper matrix that are braided around a central copper channel. These exterior cables are covered with an insulating material, a layer of vacuum impinged metalized woven polymeric fabric wrapping and a layer of thermal insulation.

In another embodiment, an apparatus is provided that has a winding support structure, made up of a stainless steel toroidal container including an upper and lower half affixed to a coil winding. In other various aspects, the apparatus may also have one or more orifices coupled to a plurality of supply leads on the lower half wherein one or more cables are separated by 180 degrees. In certain aspects, it also has mounting plates that are coaxial to the cable orifices. Finally, another aspect of the embodiment includes one or more additional struts offset by 90 degrees from the first pair of struts with the struts extending downward along one or more coil radii. In other various aspects of this aspect of the embodiment, the winding support structure has one or more surrounding layers of metalized nylon held under high vacuum; one or more layers surrounded by an airtight metal cavity; an additional layer of thermal insulation; and one or more flexible sheets of nanoporous gels wrapped in sheets and affixed together by a high strength fiber.

In another embodiment, the winding support is housed within a vacuum chamber and provides an internal vacuum such that an inner structural element surrounding the winding is sealed. Further, the winding support structure has a cooling system. The winding support structure's cooling system can have high dielectric properties. The winding support structures can have channels wherein dielectric coolant may be pumped. The channels are etched into the exterior of the solid dielectric layer. The winding support structures can have tubing composed of dielectric material that provides dielectric coolant to the coil head and through the hollowed portions of interior support struts. The winding support structures can also contain a minor radius cross section following the contour of a magnetic field line surrounding an outer metallic layer. Finely, the winding support structures can have a coil with a minor radius cross section that is slightly elliptical.

In one embodiment, a superconductive coil housed within an assembly that provides cryogenic cooling, structural support, and high potential electrical isolation from the surrounding medium. The electrical isolation consists of a layer of high-K dielectric ceramic, glass or polymer, such that the outermost metallic layer of the assembly may be held at high electric potential difference from the coil winding. A layer of vacuum-impinged mylar wrapping in conjunction with a silica-based 'aerogel' blanket provides thermal insulation with extremely low thermal conductivity. The innermost layers consist of structural support for the coil itself, which may double as flow channels for actively pumped cryogenic coolant. The toroidal coil head assembly is then supported by three or more struts, providing gravity support. These struts are hollow, providing a cavity through which cryogenic and electrical supply conduits may be run. The outermost layer of the struts, in contrast to the toroidal coil head, is a thick dielectric rather than metal. If the exterior of the coil head is to be subjected to high heat flux, an additional near room temperature cooling system may be incorporated. This system has coolant and supply lines of dielectric materials such that the exterior of the coil head may still be held at high potential despite contact with the coolant without the risk of internal arcing.

In yet another embodiment of the invention, the superconductive winding is wound radially with a circular cross section, giving a dipole magnetic field. The winding itself may be of individual superconductive filaments in a copper matrix, or of larger cable composed of multiple braided filaments and additional copper binders. The superconductive filaments may be of the high-temperature (HTSC) or low-temperature (LTSC) type. HTSC superconductors may be preferable in embodiments subject to greater heat flux, as the critical temperature for HTSC windings is higher, and subsequently the input power required to cool them is reduced. However, LTSC windings present advantages of durability under the effects of radiation, at the cost of higher cooling power requirements. In the case of both LTSC and HTSC filaments, the preferred embodiment of the invention utilizes a winding of cable-in-conduit Rutherford type cables, where superconductive filaments in a copper matrix are braided around a central copper channel. This channel is filled with the desired coolant, and pumped actively as to provide forced cooling. Possible coolants include liquid helium, liquid nitrogen and supercritical gases, as well as many others. The exterior of these cables are covered a durable electrical insulator such as polyamide. Other embodiments include a solid winding which is cooled by externally pumped cryogenic coolant, and windings cooled directly by conduction via closed-cycle cryocoolers.

In another embodiment, the complete magnet winding may then be bound together with an epoxy under vacuum impregnation, or wrapped again with polyamide, as required for the specific application. In the embodiment mentioned earlier, this element is toroidal (donut shaped), with positive and negative leads of the internally cooled Rutherford type cable extending a few coil radii such that electrical power as well as coolant flow may be provided to the winding.

In another aspect, on the exterior of the winding, the next layer is composed of winding support structure(s). In one embodiment, this consists of a stainless steel toroidal container composed of an upper and lower half, which is bolted or welded together around the coil winding. Two small orifices on the bottom half allow for the supply leads (coolant and power) to be passed through. In the preferred embodiment, these two cables are separated by 180 degrees. Coaxial to these cable orifices are mounting plates for the support struts, and two additional struts are offset by 90 degrees from the first pair. The internal structural elements of the support struts are attached here, and extend downward some number of coil radii.

In certain aspects, surrounding the steel support structure there may be multiple layers of metalized nylon (mylar). These are to be held under high vacuum, providing thermal insulation properties. In one embodiment, this layer is surrounded by an air-tight metal cavity such that the area can be evacuated to high vacuum. In another embodiment, the assembly is designed to be housed within a vacuum chamber, and to provisions for providing an internal vacuum are required. Note that in this embodiment, the inner structural element surrounding the winding is sealed, so that small coolant leaks do not ruin the vacuum.

In other various aspects, the mylar layer is surrounded by an additional layer of thermal insulation, such as extremely high R-value foam or "Aerogel" type silica-based blankets. The preferred embodiment utilizes flexible sheets of extremely low density nanoporous gels, as described by US Patent #20070173157. These may be wrapped in sheets, and held in place by high strength fiber thread, such as Dyeema or Kevlar.

In another embodiment, surrounding the thermal insulation layers elements designed for electrical isolation are present. These consist of a toroidal section of dielectric composed of an upper and lower half, or multilayer wrapping of a flexible dielectric. For maximum electrical isolation, one embodiment consists of fused-silica (low metal content glass) halves. These may be joined together by a number of methods, including melting and pressure welding of the two halves together. If this method is employed, great care must be taken as to not damage the internal coil windings, as superconductive materials are very sensitive to high temperatures. Filling the coolant chambers with a cryogenic coolant during this process is one method for minimizing the chance of thermal degradation of the windings. Another method for joining the dielectric sections involves dissolution of silicates in a hydroxide solution.

In yet another embodiment, this solution may be applied to the interface, and upon evaporation of the solution solid a solid silicate bond will remain. Another embodiment may use a wrap of flexible glass fibers around the toroidal section to the desired thickness, which are then treated with an epoxy or silicate-hydroxide solution to seal any small orifices or pores. Additional embodiments may use an epoxy-based dielectric, ceramics, or polymers. Silica and ceramics are preferred for high-temperature and vacuum applications, as polymers and epoxies tend to out-gas and degrade when heated.

In another embodiment, the exterior layer of the coil head is a rigid metallic element, designed to resist the effect of electromagnetic radiation of varying wavelengths. Radio, infrared, and soft x-ray radiation as well as intermediate wavelengths will be largely absorbed by this layer. Polishing the exterior surface will act to increase the amount of electromagnetic radiation reflected, and increase its blackbody emissivity, speeding cooling.

In another embodiment, if the electromagnetic or convective heat load on the outer layer is high, an additional cooling system may be included. In order to retain electrical isolation between the outer skin of the coil head and ground, this coolant must itself have strong dielectric properties. Highly refined mineral oil, fluorinated hydrocarbons, and silicone based commercial transformer fluids meet these requirements. Silicone based fluids are preferable, as they do not have the same risk of combustion as do mineral oils. The outer metallic element may include small channels within which the dielectric coolant may be pumped, or channel may be etched into the exterior of the solid dielectric layer, providing cooling along the metal-dielectric interface. If the latter embodiment is used, care must be taken that the solid dielectric material does not interact deleteriously with the dielectric fluid, as would be the case with a fluorinated hydrocarbon and some polymers. The tubing providing dielectric coolant to the coil head is run down the interior hollow section of the support struts, specifically those than do not house a superconductive cable lead. This tube must be also composed of dielectric material, as to avoid conducting electricity to the pumping systems, which are at ground potential.

In yet another embodiment, if high flux of neutral particle radiation such as neutrons or muons is expected, the design can incorporate a layer of radiation shielding between the outer container and the dielectric layer. This is only practical on large devices, where the minor radius of the coil exceeds 10 cm. This radiation shielding may be in the form of dense metals like lead, or borated carbon-composite sheeting.

In an embodiment, in the case of high flux of charged particles, it is beneficial to shape the outer metallic layer for maximum conformality to the magnetic field lines. This not only reduces mechanical stresses on the device, but more importantly it reduces charged particle impacts by limiting the degree to which field lines (which are the guiding centers of charged particle gyromotion) terminate on a metal surface. For a single isolated coil, the preferable minor radius cross section is slightly elliptical, with the flattened side facing inward toward the axis of the coil. For arrays of coils or in the presence of external magnetic fields, the geometry of the cross section will vary accordingly.

As described briefly before, the coil head is supported by a number of support struts, the inner structural element of which is hollow to provide a channel for support cables and conduits to be run. This element is covered with layers of thermal insulation and dielectric of similar thickness to that found on the coil head. However, there is not an outer metal layer, allowing the metal container on the coil head to be completely electrically isolated from the rest of the assembly. The struts are attached to a pair of support rings, which incorporate thermally insulated bushings and expansion joints. This prevents excessive degrees of heat from being conducted to the interior coil windings. The lower ring is attached to a mounting plate that serves as a structural base, as well as a means to attaching the assembly to the desired location.

Based on the disclosure and teachings provided herein, a person of ordinary skill in the art will appreciate other ways and/or methods to implement the various embodiments.

The specification and drawing are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A superconductive magnet assembly comprising:

a superconductive coil having one or more windings of superconductive material;

a winding housing formed by a first conduit structure circumscribing a central region and closing on itself to form a first enclosed inside region within the first conduit structure, said first enclosed inside region containing the superconductive coil with the one or more windings wound around the central region, said winding housing having an outer surface;

a region of thermal insulation encasing the outer surface of the winding housing to form a first annular structure that circumscribes the central region, wherein the winding housing and the first annular structure together form a superconducting coil subassembly circumscribing the central region;

a coil head container formed by a second conduit structure circumscribing the central region and closing on itself to form a second enclosed inside region within the coil head container, wherein said second conduit structure has an electrically conductive outer surface and said second enclosed inside region completely contains the superconductive coil subassembly, wherein the coil head container and the superconductive coil subassembly within the coil head container form a coil head assembly; and a plurality of strut supports attached to the coil head assembly and for supporting and holding the coil head assembly at a predetermined distance from a first surface, wherein the plurality of strut supports extend away from the coil head assembly toward a hypothetical plane that is parallel to and on one side of the coil head assembly, and wherein the plurality of strut supports support said coil head assembly and no other coil head assembly, wherein during use a high voltage $V_{max}$ is applied to the coil head container, wherein the predetermined distance is D and is characterized by an effective dielectric strength K, and wherein D is selected to be greater than $V_{max}/K$.

2. The superconductive magnet assembly of claim 1, wherein the predetermined distance is at least 20 centimeters.

3. The superconductive magnet assembly of claim 1, wherein the coil housing and the coil head container form an annular region therebetween and wherein the superconductive magnet assembly further comprises:

a first cooling system for cryogenically cooling the superconductive coil; and a second cooling system separate from the first cooling system for providing a coolant to said annular region.

4. The superconductive magnet assembly of claim 3, wherein the first cooling system comprises a thermally conducting rod that thermally contacts the superconductive coil.

5. The superconductive magnet assembly of claim 3, wherein the first cooling system is for providing a cryogenic coolant to the winding housing.

6. The superconductive magnet assembly of claim 3, further comprising a plurality of coolant channels proximate to the outer electrically conducting surface of the coil head container and wherein the second cooling system is for providing a coolant to the plurality of coolant channels for cooling the coil head container.

7. The superconductive magnet assembly of claim 3, further comprising a base plate assembly to which the plurality of strut supports are attached.

8. The superconductive magnet assembly of claim 3, wherein the first cooling system comprises a passageway within with one of said plurality of strut supports for carrying a cryogenic coolant to the superconductive coil within the first container.

9. The superconductive magnet assembly of claim 8, wherein the second cooling system comprises a channel formed within one of said plurality of strut supports for carrying a coolant to the annular region.

10. The superconductive magnet assembly of claim 3, further comprising a dielectric region encasing the first annular structure to form a second annular structure that circumscribes the central region, wherein the winding housing and the first and second annular structures together form the superconducting coil subassembly circumscribing the central region.

11. The superconductive magnet assembly of claim 10, further comprising a conductor passing up through one of the plurality of strut supports and connected to the second container for applying a high voltage to the coil head container.

12. The superconductive magnet assembly of claim 10, wherein during use a high voltage $V_{max}$ is applied to the coil head container, wherein the dielectric region has a thickness of D and an effective dielectric strength K and wherein D is selected to be greater than $V_{max}/K$.

13. The superconductive magnet assembly of claim 3, wherein each strut support among the plurality of strut supports comprises a support rod and a region of thermal insulation surrounding the support rod and a dielectric region surrounding the region of thermal insulation.

14. The superconductive magnet assembly of claim 1, wherein the coil head container is torroidal.

15. A superconductive magnet assembly, comprising:

a superconductive coil having one or more windings of superconductive material;

a winding housing formed by a first conduit structure circumscribing a central region and closing on itself to form a first enclosed inside region within the first conduit structure, said first enclosed inside region containing the superconductive coil with the one or more windings wound around the central region, said winding housing having an outer surface;

a region of thermal insulation encasing the outer surface of the winding housing to form a first annular structure that circumscribes the central region, wherein the winding housing and the first annular structure together form a superconducting coil subassembly circumscribing the central region;

a coil head container formed by a second conduit structure circumscribing the central region and closing on itself to form a second enclosed inside region within the coil head container, wherein said second conduit structure has an electrically conductive outer surface and said second enclosed inside region completely contains the superconductive coil subassembly, wherein the coil head container and the superconductive coil subassembly within the coil head container form a coil head assembly;

a plurality of strut supports attached to the coil head assembly and for supporting and holding the coil head assembly at a predetermined distance from a first surface, wherein the plurality of strut supports extend away from the coil head assembly toward a hypothetical plane that is parallel to and on one side of the coil, and wherein the plurality of strut supports support only said coil head assembly and no other coil head assembly; and a vacuum chamber with the coil head container positioned and supported within the vacuum chamber by the plurality of strut supports.

16. A superconductive magnet assembly comprising:

a superconductive coil having one or more windings of superconductive material;

a winding housing formed by a first conduit structure circumscribing a central region and closing on itself to form a first enclosed inside region within the first conduit structure, said first enclosed inside region containing the superconductive coil with the one or more windings wound around the central region, said winding housing having an outer surface;

a region of thermal insulation encasing the outer surface of the winding housing to form a first annular structure that circumscribes the central region;

a dielectric region encasing the first annular structure to form a second annular structure that circumscribes the central region, wherein the winding housing and the first and second annular structures together form a superconducting coil subassembly circumscribing the central region; and a coil head container formed by a second conduit structure circumscribing the central region and closing on itself to form a second enclosed inside region within the coil head container, wherein said second conduit structure has an electrically conductive outer surface and said second enclosed inside region completely contains the superconductive coil subassembly.

17. The superconductive magnet assembly of claim 16, wherein the coil head container and the superconductive coil subassembly within the coil head container form a coil head assembly and wherein said superconductive magnet assembly further comprises a plurality of strut supports attached to the coil head assembly and for holding the coil head assembly at a predetermined distance from a first surface.

18. The superconductive magnet assembly of claim 17, wherein during use a high voltage $V_{max}$ is applied to the coil head container, wherein the predetermined distance is D and is characterized by an effective dielectric strength K, and wherein D is selected to be greater than $V_{max}/K$.

19. The superconductive magnet assembly of claim 17, wherein the predetermined distance is at least 20 centimeters.

20. The superconductive magnet assembly of claim 16, further comprising a base plate assembly to which the plurality of strut supports are attached.

21. The superconductive magnet assembly of claim 20, wherein the coil housing and the coil head container form an annular region therebetween and wherein the superconductive magnet assembly further comprises:

a first cooling system for cryogenically cooling the superconductive coil; and a second cooling system separate from the first cooling system for providing a coolant to said annular region.

22. The superconductive magnet assembly of claim 21, wherein the first cooling system comprises a passageway within with one of said plurality of strut supports for carrying a cryogenic coolant to the superconductive coil within the first container.

23. The superconductive magnet assembly of claim 22, further comprising a plurality of coolant channels proximate to the electrically conductive outer surface of the coil head container for carrying the coolant to cool the coil head container.

24. The superconductive magnet assembly of claim 16, wherein the dielectric region comprises a material selected from the group consisting of ceramic, polymer, and glass.

25. The superconductive magnet assembly of claim 16, wherein the dielectric region comprises a vacuum separating the coil head container from the first annular structure.

26. A superconductive magnet assembly comprising:

a superconductive coil having one or more windings of superconductive material;

a winding housing formed by a first conduit structure circumscribing a central region and closing on itself to form a first enclosed inside region within the first conduit structure, said first enclosed inside region containing the superconductive coil with the one or more windings wound around the central region, said winding housing having an outer surface;

a region of thermal insulation encasing the outer surface of the winding housing to form a first annular structure that circumscribes the central region;

a dielectric region encasing the first annular structure to form a second annular structure that circumscribes the central region, wherein the winding housing and the first and second annular structures together form a superconducting coil subassembly circumscribing the central region;

a coil head container formed by a second conduit structure circumscribing the central region and closing on itself to form a second enclosed inside region within the coil head container, wherein said second conduit structure is made of an electrically conductive material and said second enclosed inside region completely contains the superconductive coil subassembly, wherein the coil head container and the superconductive coil subassembly within the coil head container form a coil head assembly; and a plurality of strut supports attached to the coil head assembly and for supporting and holding the coil head assembly at a predetermined distance from a first surface.

27. The superconductive magnet assembly of claim 26, wherein during use a high voltage $V_{max}$ is applied to the coil head container, wherein the predetermined distance is D and is characterized by an effective dielectric strength K, and wherein D is selected to be greater than $V_{max}/K$.

28. The superconductive magnet assembly of claim 26, wherein the predetermined distance is at least 20 centimeters.

29. A plasma system comprising:

a superconductive magnet assembly which during operation is in proximity to a plasma within the plasma system;

a cryogenic cooling system for cryogenically cooling the superconductive magnet assembly;

a pumping system for supplying and circulating a dielectric coolant to the superconductive magnet assembly; and a high voltage power supply for supplying a high voltage to the superconductive magnet assembly, wherein the superconductive magnet assembly comprises:

a superconductive coil having one or more windings of superconductive material;

a winding housing formed by a first conduit structure circumscribing a central region and closing on itself to form a first enclosed inside region within the first conduit structure, said first enclosed inside region containing the superconductive coil with the one or more windings of the superconductive material arranged along the length of the first conduit structure, said winding housing having an outer surface;

a layer of thermal insulation material encasing the outer surface of the winding housing to form a first annular structure that circumscribes the central region, wherein the winding housing and the first annular structure together form a superconducting coil subassembly circumscribing the central region;

a coil head container formed by a second conduit structure circumscribing the central region and closing on itself to form a second enclosed inside region within the coil head container, wherein said second conduit structure has an electrically conductive outer surface and said second enclosed inside region completely contains the superconductive coil subassembly, wherein the coil housing and the coil head container form an annular region therebetween;

a first cooling system for cryogenically cooling the superconductive coil; and a second cooling system separate from the first cooling system comprising a plurality of coolant channels proximate to the electrically conductive outer surface of the coil head container, said second cooling system for providing a coolant to said plurality of coolant channels to cool said coil head container, wherein during operation cryogenic cooling system supplies a cryogenic coolant to the first cooling system, the second pump supplies the dielectric coolant to the second cooling system, and the high voltage power supply supplies the high voltage to the coil head container.

30. The plasma system of claim 29, further comprising a layer of dielectric material encasing the first annular structure to form a second annular structure that circumscribes the central region, wherein the winding housing and the first and second annular structures together form the superconducting coil subassembly circumscribing the central region.

31. The plasma system of claim 30, wherein the coil head container and the superconductive coil subassembly within the coil head container form a coil head assembly and wherein said superconductive magnet assembly further comprises a plurality of strut supports attached to the coil head assembly and for holding the coil head assembly at a predetermined distance from a first surface.

32. The plasma system of claim 30, wherein the plurality of strut supports support only said coil head assembly and no other coil head assembly.

33. The plasma system of claim 31, wherein the predetermined distance is at least 20 centimeters.

34. The plasma system of claim 31, further comprising a vacuum chamber with the coil head container positioned and supported within the vacuum chamber by the plurality of strut supports.

* * * * *